US012722921B2

(12) United States Patent
Fujikura et al.

(10) Patent No.: US 12,722,921 B2
(45) Date of Patent: Sep. 1, 2026

(54) MEDIUM FEEDING DEVICE AND MEDIUM PROCESSING DEVICE INCLUDING THE SAME

(71) Applicant: FUJIFILM Business Innovation Corp., Tokyo (JP)

(72) Inventors: Hiroaki Fujikura, Yokohama (JP); Yoshiyuki Kitazawa, Yokohama (JP); Yohei Onoue, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 152 days.

(21) Appl. No.: 17/887,019

(22) Filed: Aug. 12, 2022

(65) Prior Publication Data

US 2023/0312279 A1 Oct. 5, 2023

(30) Foreign Application Priority Data

Mar. 29, 2022 (JP) ..... 2022-054313

(51) Int. Cl.
*B65H 3/48* (2006.01)
*B65H 7/02* (2006.01)

(52) U.S. Cl.
CPC ..... *B65H 3/48* (2013.01); *B65H 7/02* (2013.01); *B65H 2301/152* (2013.01)

(58) Field of Classification Search
CPC ..... B65H 3/48; B65H 7/02; B65H 2301/152
See application file for complete search history.

(56) References Cited

U.S. PATENT DOCUMENTS 10,829,326 B2 11/2020 Matsui
2007/0228639 A1 10/2007 Matsumoto et al.
(Continued)

FOREIGN PATENT DOCUMENTS

JP 2014-172700 A 9/2014
JP 2015-024868 A 2/2015
(Continued)

OTHER PUBLICATIONS

May 23, 2023 Search Report issued in European Patent Application No. 22198675.5.
(Continued)

*Primary Examiner* — Thomas A Morrison
(74) *Attorney, Agent, or Firm* — Oliff PLC

(57) ABSTRACT

A medium feeding device includes a container member that accommodates sheet media, a discharging member located further than the media accommodated in the container member in a discharging direction in which the media are discharged, to discharge the media one by one, a hand-over member disposed above the container member to suck the media accommodated in the container member with air and pass the media to the discharging member, a floating device disposed on a side of the media accommodated in the container member to blow air to an upper area of a side end surface of the media to float the media while an upper portion of the media is separated, a detector that detects a separation state of the medium floated by the floating device, and a controller that controls a medium-feeding operation including a pre-feeding blowing operation and a during-feeding blowing operation, the pre-feeding blowing operation serving as an air blowing operation performed by the floating device before the medium is fed, and the during-feeding blowing operation serving as an air blowing operation performed by the floating device from a start of feeding the medium and an end of feeding the medium. While performing the pre-feeding blowing operation or the during-feeding blowing operation, the controller performs detection with the detector, and on condition that a result of the detection fails to satisfy a preset target range, the controller changes a parameter for the medium-feeding operation including at least one of the pre-feeding blowing operation or the during-feeding blowing operation.

20 Claims, 28 Drawing Sheets

(56) References Cited

U.S. PATENT DOCUMENTS

| | | | | |
|---|---|---|---|---|
| 2012/0154795 | A1* | 6/2012 | Kobayashi | B65H 3/5261 356/213 |
| 2014/0265105 | A1* | 9/2014 | Shimoyama | B65H 3/48 271/12 |
| 2015/0021848 | A1* | 1/2015 | Mizuno | B65H 3/48 271/12 |
| 2015/0029525 | A1* | 1/2015 | Shimoyama | B65H 7/16 358/1.12 |
| 2019/0202647 | A1* | 7/2019 | Sugawara | B65H 1/14 |
| 2020/0299089 | A1* | 9/2020 | Matsui | B65H 7/16 |

FOREIGN PATENT DOCUMENTS

| | | | |
|---|---|---|---|
| JP | 2017-105563 | A | 6/2017 |
| JP | 2018-111571 | A | 7/2018 |
| JP | 2018-135214 | A | 8/2018 |
| JP | 2018-193231 | A | 12/2018 |
| JP | 2019-048676 | A | 3/2019 |
| JP | 2020-152561 | A | 9/2020 |
| JP | 2021-088417 | A | 6/2021 |

OTHER PUBLICATIONS

Dec. 16, 2025 Office Action issued in Japanese Patent Application No. 2022-054313.
May 12, 2026 Office Action issued in Japanese Patent Application No. 2022-054313.

* cited by examiner

MEDIUM FEEDING DEVICE AND MEDIUM PROCESSING DEVICE INCLUDING THE SAME

CROSS-REFERENCE TO RELATED APPLICATIONS

This application is based on and claims priority under 35 USC 119 from Japanese Patent Application No. 2022-054313 filed Mar. 29, 2022.

BACKGROUND

(i) Technical Field

The present disclosure relates to a medium feeding device that feeds media such as sheets one by one, and a medium processing device including the same.

(ii) Related Art

For example, a device described in Japanese Unexamined Patent Application Publication No. 2020-152561 (Detailed Descriptions and FIG. 7) is known as this type of medium feeding device.

Japanese Unexamined Patent Application Publication No. 2020-152561 (Detailed Descriptions and FIG. 7) describes a sheet feeding device including a sheet feeding belt disposed above sheets set on a set board and having a suction hole, a suction device that sucks air from the sheet feeding belt to produce floating air to suck the set sheets, a discharging mechanism that discharges sheets by rotating the sheet feeding belt, an interval measuring unit that measures an interval between the sheets while the suction device sucks the sheets, and a controller that identifies the interval between the sheets based on an output from the interval measuring unit, and adjusts the airflow rate of the floating air based on the identified interval between the sheets.

SUMMARY

Aspects of non-limiting embodiments of the present disclosure relate to, while performing a method of feeding media by floating and sucking the media one by one, further reducing sheet feeding failures by determining an operation of floating each medium than when feeding media with constantly unchanged parameters.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a medium feeding device including a container member that accommodates sheet media, a discharging member located further than the media accommodated in the container member in a discharging direction in which the media are discharged to discharge the media one by one, a hand-over member disposed above the container member to suck the media accommodated in the container member with air and pass the media to the discharging member, a floating device disposed on a side of the media accommodated in the container member to blow air to an upper area of a side end surface of the media to float the media while an upper portion of the media is separated, a detector that detects a separation state of the medium floated by the floating device, and a controller that controls a medium-feeding operation including a pre-feeding blowing operation and a during-feeding blowing operation, the pre-feeding blowing operation serving as an air blowing operation performed by the floating device before the medium is fed, and the during-feeding blowing operation serving as an air blowing operation performed by the floating device from a start of feeding the medium to an end of feeding the medium, wherein while performing the pre-feeding blowing operation or the during-feeding blowing operation, the controller performs detection with the detector. On condition that a result of the detection fails to satisfy a preset target range, the controller changes a parameter for the medium-feeding operation including at least one of the pre-feeding blowing operation or the during-feeding blowing operation.

BRIEF DESCRIPTION OF THE DRAWINGS

Exemplary embodiments of the present disclosure will be described in detail based on the following figures, wherein:

FIG. 10A illustrates a state where the suction mechanism performs sucking, and FIG. 10B illustrates a state where the suction mechanism stops sucking;

FIG. 12A is a state where an air outlet of the shutter mechanism is shut, and FIG. 12B is a state where the air outlet of the shutter mechanism is open;

FIG. 13A is a diagram illustrating a case where the direction in which air from the air outlet is blown is partially changed, FIG. 13B is a cross-sectional view taken along line XIIIB-XIIIB in FIG. 13A, and FIG. 13C is a diagram illustrating a case where a pattern in which air from the air outlet is blown is used as a parameter to be changed;

FIG. 28A is a diagram illustrating the behavior exhibited to raise the medium reference height, FIG. 28B is a diagram illustrating the operation when the medium reference height is raised, FIG. 28C is a diagram illustrating the behavior exhibited to lower the medium reference height, and FIG. 28D is a diagram illustrating the operation when the medium reference height is lowered; FIG. 29A is a diagram of a basic operation of the separation plate, FIG. 29B is a diagram of the operation when the position of the separation plate is raised, and FIG. 29C is a diagram of the operation when the position of the separation plate is lowered.

DETAILED DESCRIPTION

Summary of Exemplary Embodiments

Figure 1A:
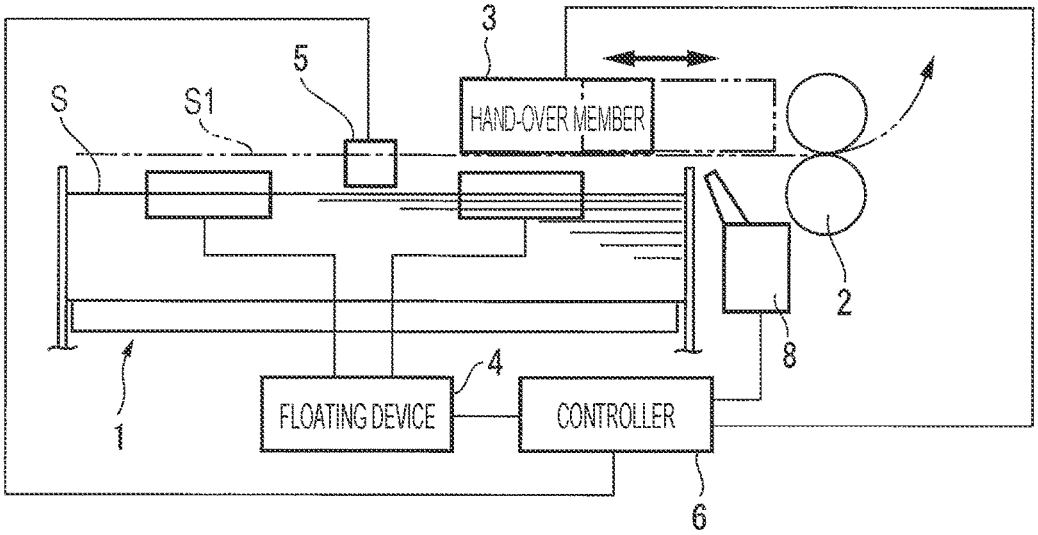
FIG. 1A is a rough schematic diagram of a medium feeding device according to an exemplary embodiment of the present disclosure.

FIG. 1A is a rough diagram of a medium feeding device according to an exemplary embodiment of the present disclosure.

Figure 1B:
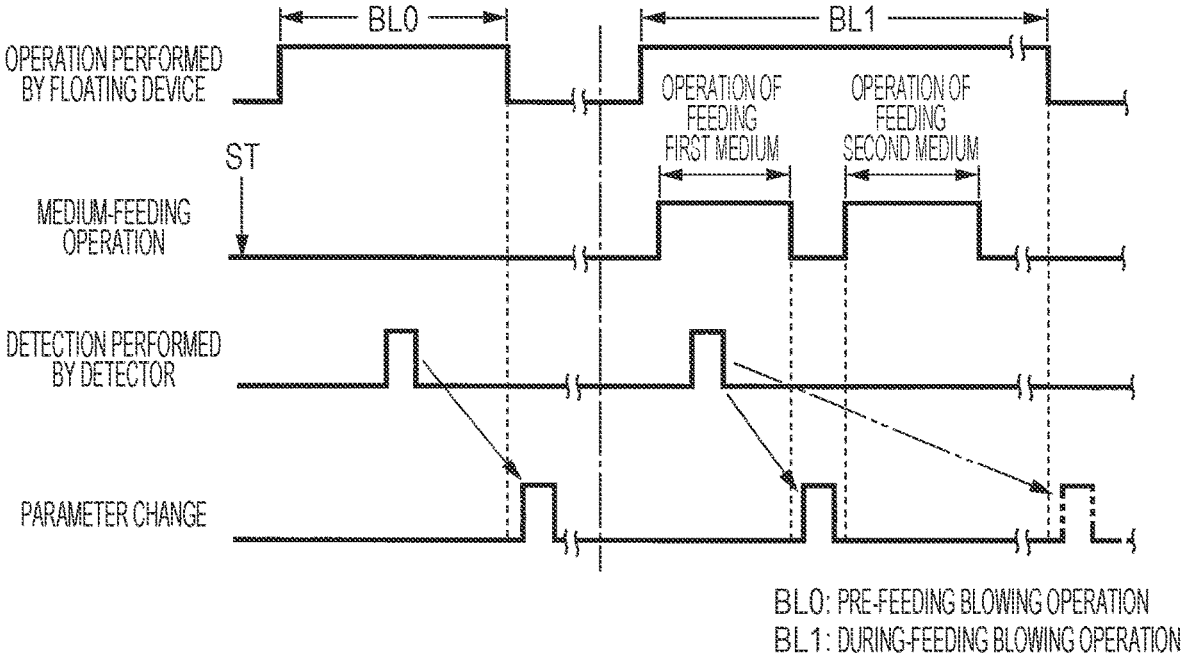
FIG. 1B is a rough timing chart of a control operation performed by a controller.

In FIG. 1A, the medium feeding device includes a container member 1 that accommodates sheet media S, a discharging member 2 that is disposed further than the media S accommodated in the container member 1 in a discharging direction in which the media S are discharged to discharge the media S one by one, a hand-over member 3 that is disposed above the container member 1, sucks the media S (more specifically, a medium S1 located uppermost) accommodated in the container member 1 with air and passes the media S to the discharging member 2, a floating device 4 that is disposed on a side of the media S accommodated in the container member 1, that blows air to an upper area of a side end surface of the media to float the media S while an upper portion of the media S is separated, a detector 5 that detects a separation state of the media floated by the floating device 4, and a controller 6 that controls a medium-feeding operation including a pre-feeding blowing operation BL0 serving as an air blowing operation performed by the floating device 4 before the media S are fed, and a during-feeding blowing operation BL1 serving as an air blowing operation performed by the floating device 4 from a start of feeding the media S to an end of feeding the media S. As illustrated in FIG. 1B, while performing the pre-feeding blowing operation BL0 or the during-feeding blowing operation BL1, the controller 6 performs detection with the detector 5. When a result of the detection fails to satisfy a preset target range, the controller 6 changes a parameter for a medium-feeding operation including at least one of the pre-feeding blowing operation BL0 or the during-feeding blowing operation BL1.

The medium feeding device of this type is installed in a medium processing device including a processing member not illustrated that performs a predetermined process on the media S, and used as a device that embodies a function of feeding the media S to the processing member.

In this case, in addition to an image forming member that forms images on the media S, examples of the processing member include a device that performs various processing on media such as forming holes in media, cutting media, sorting media, or folding media.

In such as a technical member, the container member 1 generally includes a mount that receives the media S thereon, and the mount is usually supported by a hoist mechanism to be movable upward and downward. In an aspect of accommodating the media S of various different sizes, the container member 1 includes side guides and a rear guide.

Examples of the discharging member 2 include a wide range of members that discharge media, and a typical example of the discharging member 2 includes a pair of discharging rollers or a set of a discharging roller and a discharging belt.

Any member, such as a transport shuttle (a component of a vacuum head) or a transport belt, that sucks media one by one, passes the media to the discharging member 2, and returns to the initial position may be appropriately selected as the hand-over member 3.

Any member that blows air to the upper area of the accommodated media S from the side of the container member 1 (including from the front or rear side in a medium discharging direction besides from the side in a width direction crossing the medium discharging direction) may be selected as the floating device 4.

Any member that images a side end surface of each medium such as a camera or sensor and that detects the separation state of the media S floated by the floating device 4 may be selected as the detector 5 as appropriate.

In addition, instead of an aspect of controlling the pre-feeding blowing operation BL0 before medium feeding and the during-feeding blowing operation BL1 during medium feeding, the controller 6 controls parameters for the medium-feeding operation including these operations BL0 and BL1 (including an air suction operation performed by the hand-over member 3, and including, in an aspect including an air handling member 8 that blows air to separate an upper medium S1 that has floated toward the side end in a discharging direction of the floating medium S from a medium S located below the upper medium S1, an air blowing operation performed by the air handling member 8, an operation of controlling the position of the uppermost one of the media S1 accommodated in the container member 1, and a control operation for separating media transported in an overlapping manner). The controller 6 identifies the separation state of the media S that float during the pre-feeding blowing operation BL0 or the during-feeding blowing operation BL1, and changes, when the separation state of the media S deviates from a predetermined tolerance range, the parameters for the medium-feeding operation to change the medium-feeding operation conditions to more appropriate conditions.

Subsequently, a typical aspect or a preferable aspect of a medium feeding device according to an exemplary embodiment will be described.

First, as a typical aspect of the controller 6 that performs the pre-feeding blowing operation BL0, as illustrated in FIG. 1B, after the media S are feedably accommodated in the container member 1 (corresponding to "medium setting ST" in the drawing), the controller 6 performs detection with the detector 5 at a timing when predetermined time elapses from the start of the pre-feeding blowing operation BL0 and during the pre-feeding blowing operation BL0, and changes a parameter for a medium-feeding operation including at least the pre-feeding blowing operation BL0, on condition that a result of the detection fails to satisfy a preset target range.

In this example, on condition that the controller 6 has changed a parameter after performing detection with the detector 5, while performing the pre-feeding blowing operation BL0 after an elapse of predetermined time, the controller 6 preferably performs detection with the detector again on the pre-feeding blowing operation BL0 performed using the previously changed parameter, and on condition that a result of the detection fails to satisfy a preset target range, the controller 6 preferably changes a parameter for the medium-feeding operation at least including the pre-feeding blowing operation BL0.

As a typical aspect of the controller 6 that performs the during-feeding blowing operation BL1, as illustrated in FIG. 1B, after the media S are feedably accommodated in the container member 1 and during the during-feeding blowing operation BL1, the controller 6 performs detection with the detector 5 at predetermined time intervals, and on condition that a result of the detection fails to satisfy a preset target range, the controller 6 changes a parameter for a medium-feeding operation including at least the during-feeding blowing operation BL1.

In this example, on condition that the controller 6 has changed a parameter after performing detection with the detector 5 while performing the during-feeding blowing operation BL1, the controller 6 preferably performs detection with the detector 5 again on the during-feeding blowing operation BL1 performed using the previously changed parameter after an elapse of predetermined time, and on condition that a result of the detection fails to satisfy a preset target range, the controller 6 preferably changes a parameter for the medium-feeding operation at least including the during-feeding blowing operation BL1.

In addition, in a typical aspect of the controller 6 that performs both the pre-feeding blowing operation BL0 and the during-feeding blowing operation BL1, as illustrated in FIG. 1B, after the media S are feedably accommodated in the container member 1, the controller 6 performs detection with the detector 5 during both the pre-feeding blowing operation BL0 and the during-feeding blowing operation BL1, and on condition that a result of the detection fails to satisfy a preset target range, the controller 6 changes a parameter for a medium-feeding operation including at least one of the pre-feeding blowing operation BL0 or the during-feeding blowing operation BL1.

In this example, to perform detection with the detector 5 first while performing the during-feeding blowing operation BL1, on condition that the controller 6 has changed a parameter after performing detection with the detector 5 during the pre-feeding blowing operation BL0, the controller 6 preferably performs detection with the detector 5 on the during-feeding blowing operation BL1 performed using the parameter changed during the pre-feeding blowing operation BL0. On condition that a result of the detection fails to satisfy a preset target range, the controller 6 preferably changes a parameter for the medium-feeding operation at least including the during-feeding blowing operation BL1. To perform second or later detection with the detector 5 while performing the during-feeding blowing operation BL1, on condition that the controller 6 has changed a parameter after performing previous detection with the detector 5 while performing the during-feeding blowing operation BL1, the controller 6 preferably performs detection with the detector 5 again on the during-feeding blowing operation BL1 performed using the previously changed parameter after an elapse of predetermined time. On condition that a result of the detection fails to satisfy a preset target range, the controller 6 preferably changes a parameter for the medium-feeding operation at least including the during-feeding blowing operation BL1.

In a preferable aspect of the controller 6, the controller 6 preferably performs detection with the detector 5 during the during-feeding blowing operation BL1 and in a period immediately after the discharging member 2 finishes delivering the medium S and before a next medium S adheres to the hand-over member 3. In this example, the detector 5 performs detection on the floating state of the medium S depending only on the floating device 4. This example is preferable in that the detection is not affected by the medium-feeding operation performed by any device other than the floating device 4.

Examples of other preferable aspects of the controller 6 include an aspect where, when intermittent operations are intermittently performed during the medium-feeding operation while the during-feeding blowing operation BL1 is performed, a timing when the intermittent operations are not performed is set as a parameter change timing. In other words, in this example, parameters are not changed during the intermittent operations performed intermittently.

For example, as illustrated in FIG. 1B, assume an example case where detection is performed with the detector 5 during an operation of feeding a first medium S. In this case, examples of intermittent operations intermittently performed in the medium-feeding operation include an air suction operation performed by the hand-over member 3, and an air blowing operation performed by the air handling member 8. For these operations, parameters are changed at a timing when each intermittent operation is not performed (for example, in a non-operational time period in the medium-feeding operation or a time period between the operation of feeding a first medium S and the operation of feeding a second medium S).

As illustrated in FIG. 1B, the during-feeding blowing operation BL1 performed by the floating device 4 is not finished during the medium-feeding operation. As indicated with a solid line in FIG. 1B, when the during-feeding blowing operation BL1 is finished in a time period when the medium-feeding operation is finished, a parameter change for the floating device 4 may be performed. However, for example, when a job of feeding successive media S is instructed, to efficiently perform the medium-feeding operation, the during-feeding blowing operation BL1 is frequently successively performed without being stopped during the time period between the medium-feeding operations as illustrated in FIG. 1B. In such a case, the parameter change for the floating device 4 is performed after the during-feeding blowing operation is finished as indicated with a virtual line in FIG. 1B.

In this example, in a preferable aspect, to avoid useless detection with the detector 5, the controller 6 does not perform next detection with the detector 5 while performing the during-feeding blowing operation BL1 on condition that a parameter change determined from a previous detection result from the detector 5 is not yet performed.

In another preferable aspect, to avoid useless detection and parameter change performed by the detector 5, the controller 6 does not perform any of detection with the detector 5, parameter change, and detection and parameter change for a predetermined time length after a parameter change while the during-feeding blowing operation BL1 is performed.

In a preferable aspect, the controller 6 performs detection with the detector 5 after repeatedly performing detection and a parameter change a specific number of times while performing the during-feeding blowing operation BL1, and includes a limiter that limits, on condition that a result of the detection fails to satisfy a target range, the operation of feeding subsequent media S after finishing the operation of feeding the currently fed medium S.

Examples of the "limiter" in this case include a form of stopping the operation of feeding the media S, a form of notifying that the operation of feeding the media S is out of a target range, and a form of repeating a determining operation until a result of the detection satisfies the target range after the operation of feeding the media S is temporarily stopped.

In another preferable aspect, the controller 6 performs detection with the detector 5 after repeating, a specific number of times, detection with the detector 5 and a parameter change while performing the pre-feeding blowing operation BL0, and includes a terminator that terminates the pre-feeding blowing operation on condition that a result of the detection fails to satisfy the target range.

When the "terminator" terminates the pre-feeding blowing operation, the termination may be notified to a user, or may directly shift to the during-feeding blowing operation, counting on the subsequent step.

As a typical aspect, to keep the interval between the media S within an appropriate range, the detector 5 detects the interval between, of all the media S that float in the detection area as a medium separation state, media vertically adjacent to each other to determine whether the interval is within a target range, for example, whether no interval is narrower than a predetermined range.

As another typical aspect, to keep the media S in a separation state instead of being piled, the detector 5 detects the thickness of the media S floating in the detection area, to determine whether the thickness is within a target range, for example, whether none of the media has a thickness exceeding a predetermined range.

Preferably, the target range is variably set depending on the information of type of media S. In this case, "the information of type of media S" includes, for example, a brand, a size, and a basis weight.

In another preferable aspect, the controller 6 controls an air suction operation performed by the hand-over member 3 in addition to the pre-feeding blowing operation BL0 and the during-feeding blowing operation BL1 performed by the floating device 4, and is capable of changing the parameters to be controlled.

In another preferable aspect, the controller 6 includes the air handling member 8 that blows air to separate an upper medium S floated by the floating device 4 toward an end of the floating medium S in the discharging direction from a medium located below the upper medium S. The controller 6 controls an air blowing operation performed by the air handling member 8 in addition to the pre-feeding blowing operation BL0 and the during-feeding blowing operation BL1 performed by the floating device 4, and is capable of changing the parameters to be controlled.

Parameters for the medium-feeding operation may be selected as appropriate, and typical examples of parameters include at least one of an airflow rate, a direction of air, an area to which air is blown, an air temperature, an air suction rate, an initial uppermost position of the accommodated media, or a separation position of overlapping media.

Hereinbelow, the present disclosure will be further described in detail based on exemplary embodiments illustrated in appended drawings.

First Exemplary Embodiment

Figure 2:
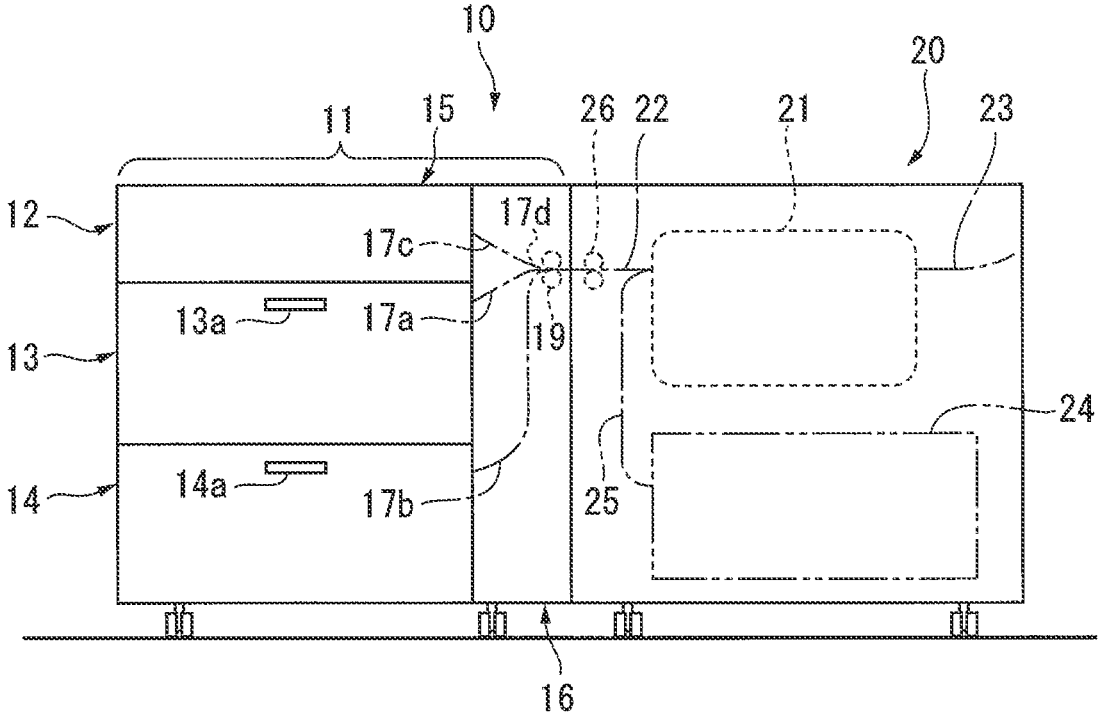
FIG. 2 is a diagram of the entire structure of a medium processing device according to a first exemplary embodiment.

FIG. 2 is a diagram of the entire structure of a medium processing device according to a first exemplary embodiment.

Entire Structure of Medium Processing Device

In FIG. 2, a medium processing device 10 includes a medium feeding device 11 that feeds sheet media one by one, and a processing unit 20 that serves as a processing member that performs a predetermined process on the media fed from the medium feeding device 11.

In the present example, the processing unit 20 includes an image forming unit 21 that forms images on the media. The image forming unit 21 employs various image forming methods such as an electrophotographic system or an inkjet printing method. The processing unit 20 includes an importing path 22 along which media fed from the medium feeding device 11 are transported to the image forming unit 21, and an exporting path 23 along which media undergoing image formation at the image forming unit 21 are transported out of the processing unit 20. In this example, the processing unit 20 separately includes a built-in medium feeder 24 below the image forming unit 21. Media from the medium feeder 24 are also fed to the image forming unit 21 through a feed transport path 25. Importing rollers 26 are disposed at the entrance of the importing path 22. An appropriate number of transporting members are disposed at the importing path 22, the exporting path 23, and the feed transport path 25.

Entire Structure of Medium Feeding Device

Figure 3:
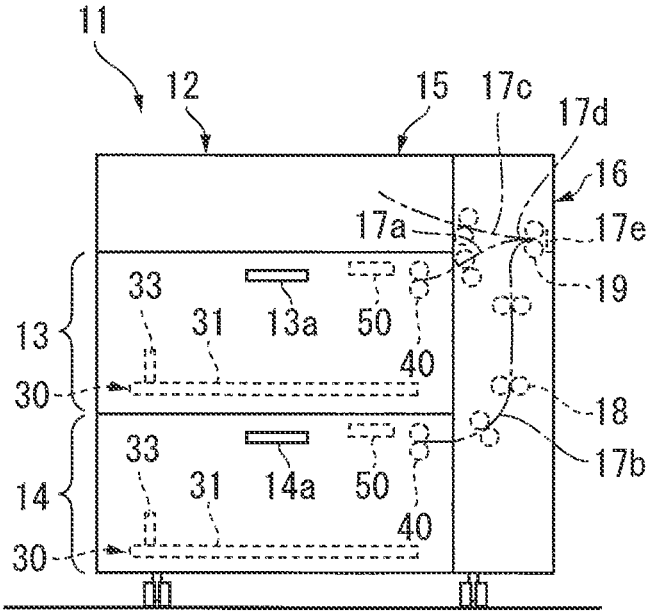
FIG. 3 is diagram of a medium feeding device included in the medium processing device according to the first exemplary embodiment.

In this example, as illustrated in FIG. 2 and FIG. 3, the medium feeding device 11 includes a housing 12 that accommodates media. The housing 12 includes an upper drawer 13 and a lower drawer 14 vertically arranged in two stages to be drawable outward, and a manual feeder 15 disposed at an upper portion of the housing 12 to allow media to be manually fed therethrough. The medium feeding device 11 also includes a relay unit 16 on the side of the housing 12 closer to the processing unit 20. The relay unit 16 relays media fed from the upper drawer 13, the lower drawer 14, and the manual feeder 15 to transport the media to the processing unit 20.

In this example, both the upper drawer 13 and the lower drawer 14 accommodate a large number of media and feed the media one by one. The relay unit 16 includes a first transport path 17*a* along which the media fed from the upper drawer 13 are transported, a second transport path 17*b* along which the media fed from the lower drawer 14 are transported, and a third transport path 17*c* along which the media fed from the manual feeder 15 are transported. An appropriate number of transport rollers 18 are disposed at the first to third transport paths 17*a* to 17*c*. A merging transport path 17*d* that is continuous with an outlet port 17*e* leading to the processing unit 20 is disposed at the exit side of each of the first to third transport paths 17*a* to 17*c*. Discharge rollers 19 are disposed at the merging transport path 17*d*. The upper drawer 13 and the lower drawer 14 respectively include pulls 13*a* and 14*a* to be drawable to the near side.

Structure Example of Upper Drawer (Lower Drawer)

In this example, the upper drawer 13 and the lower drawer 14 have substantially the same structure. Hereinbelow, the upper drawer 13 is described as an example.

Figure 4:
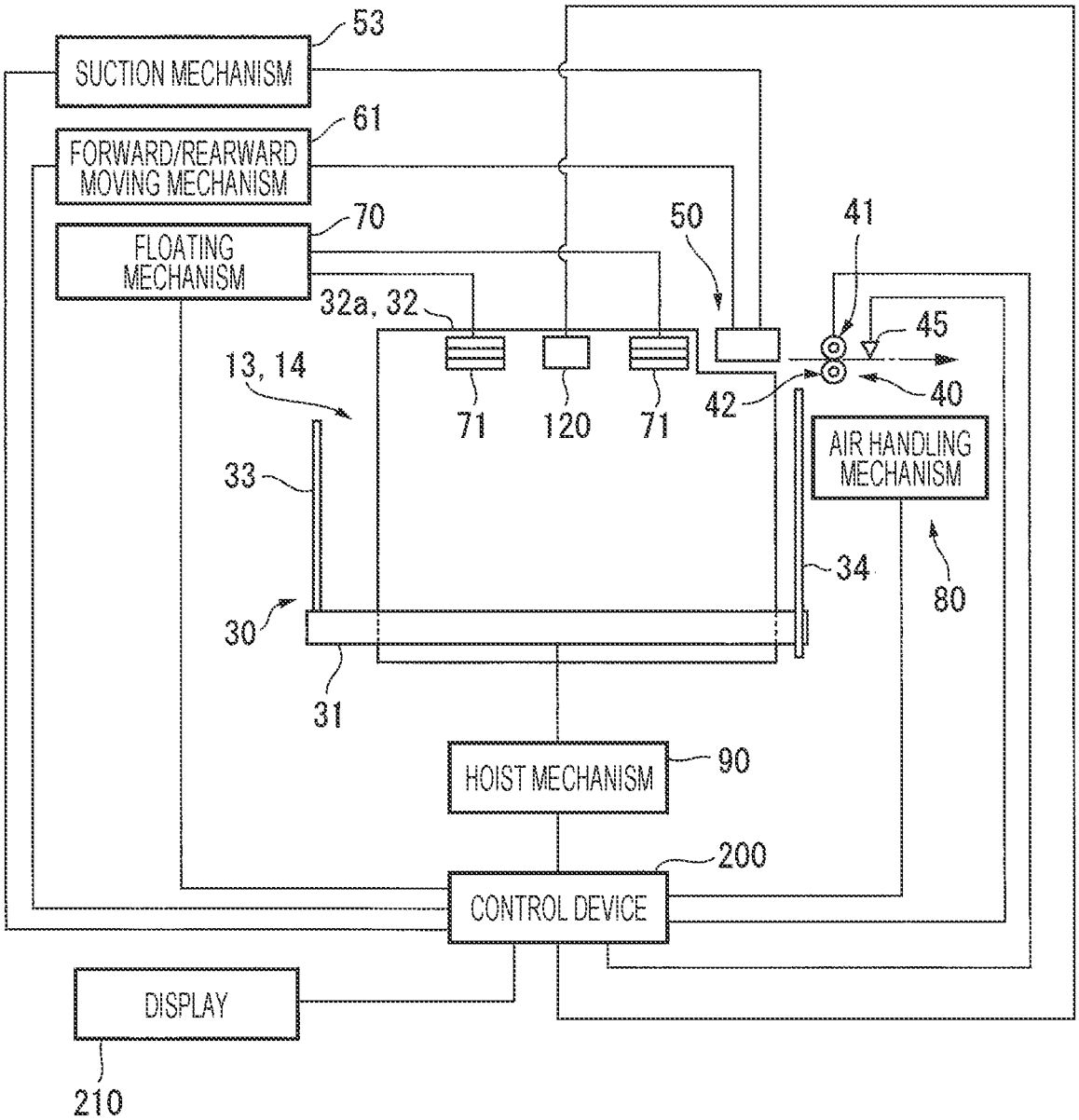
FIG. 4 is a diagram of a drive control system in the medium feeding device according to the first exemplary embodiment.

In this example, as illustrated in, for example, FIG. 4, the upper drawer 13 includes a container 30 serving as a container member that accommodates sheet media, discharging rollers 40 serving as a discharging member disposed further than the media accommodated in the container 30 in a discharging direction in which the media are discharged to discharge the media one by one, a vacuum head 50 disposed above the container 30 to serve as a hand-over member that sucks the media accommodated in the container 30 with air and passes the media to the discharging rollers 40, a floating mechanism 70 that is disposed on a side in a direction crossing the discharging direction in which the media accommodated in the container 30 is discharged, the floating mechanism 70 serving as a floating device that blows air to the side of the media to float the media while separating the upper area of the media, an air handling mechanism 80 disposed further than the media accommodated in the container 30 in a discharging direction in which the media are discharged, the air handling mechanism 80 blowing air to separate an upper medium floated by the floating mechanism 70 from a medium located below the upper media, and a flotation detector 120 that detects a separation state of each medium floated by the floating mechanism 70.

Container

Figure 5:
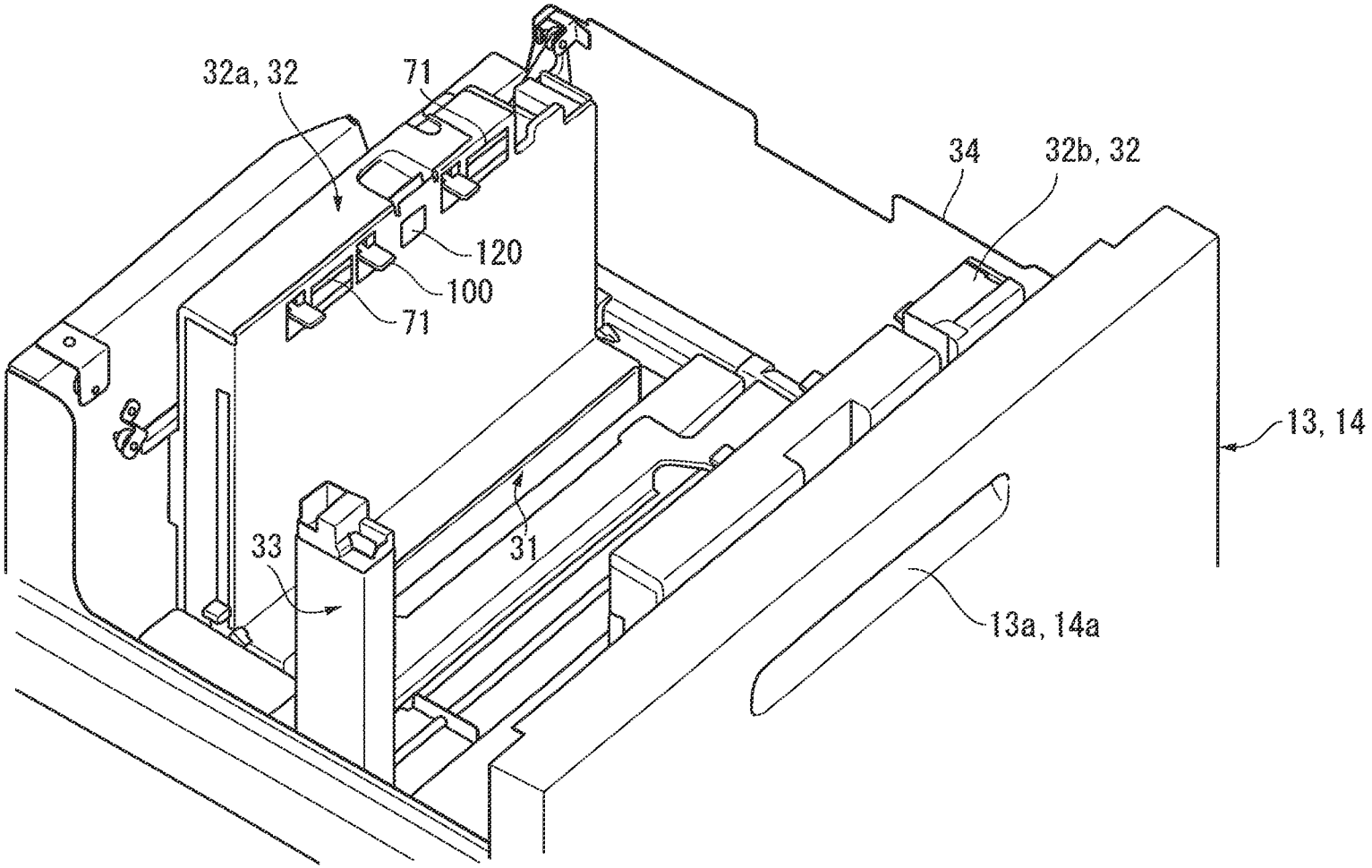
FIG. 5 is a perspective view of a medium container in the medium feeding device according to the first exemplary embodiment.

In this example, as illustrated in FIG. 4 and FIG. 5, the container 30 includes a receiving bottom plate 31 that receives media of various sizes, side guides 32 (more specifically, 32*a* and 32*b*) disposed on the sides in a width direction crossing the discharging direction of media of various sizes placed on the receiving bottom plate 31 to serve as side guide members that fix and guide the side position of the media, an end guide 33 disposed at a rear side opposite to the side in the discharging direction in which the media loaded on the receiving bottom plate 31 are discharged to serve as a rear guide member that fixes and guides the rear position of the media, and a partitioning plate 34 that defines the position of the media loaded on the receiving bottom plate 31 in the discharging direction in which the media are discharged.

In this example, the container 30 may be designed in accordance with the size of media to be used. However, in view of high versatility, preferably, a normal-size medium is to be mainly used. In this case, examples of the normal-size medium include media with a length up to 488 mm. An example of media with such a size corresponds to media of A3 size or smaller in Japanese Industrial Standards (JIS).

In this example, examples of medium include, in addition to media with a uniform thickness, a medium with an uneven thickness such as an envelope that varies in thickness in the discharging direction.

In this example, the side guides 32 are movable in the width direction of the receiving bottom plate 31, and fixed in a predetermined fixed position. The end guide 33 is movable in the discharging direction of the media on the receiving bottom plate 31, and fixed in a predetermined fixed position. In this example, a separation plate 35 (refer to FIG. 7) protrudes upward from the upper edge of the partitioning plate 34. The separation plate 35 serves as a stopper wall that stops the upper area of a pile of the media located below the medium sucked by the vacuum head 50 with air.

<Hoist Mechanism>

As illustrated in FIG. 4, the receiving bottom plate 31 is supported by a hoist mechanism 90 described below (refer to FIGS. 6A and 6B) to be movable upward and downward.

Figure 6A:
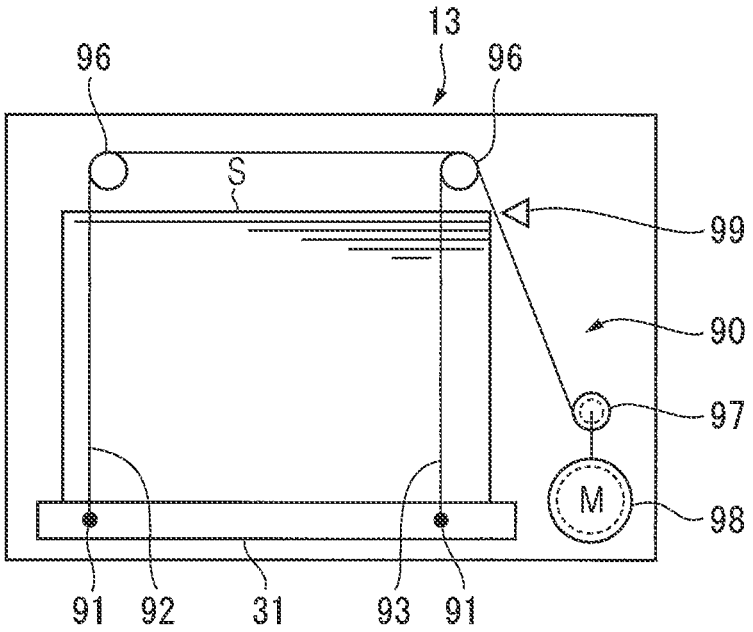
FIG. 6A is a diagram of a hoist mechanism illustrated in FIG. 4.
Figure 6B:
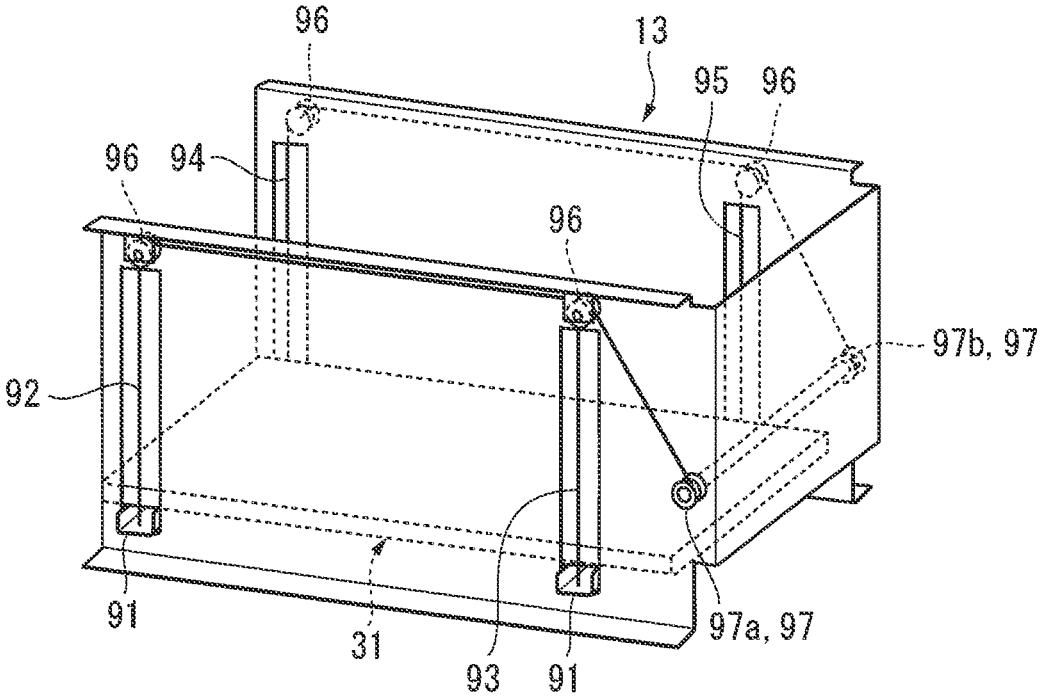
FIG. 6B is a perspective view of a related portion of the hoist mechanism illustrated in FIG. 6A.

In this example, as illustrated in FIGS. 4, 6A, and 6B, the hoist mechanism 90 includes suspension portions 91 disposed at four portions of the receiving bottom plate 31 at both sides in the width direction crossing the medium discharging direction, and four wires 92 to 95 having the far ends coupled to the respective suspension portions 91. After each of the wires 92 to 95 is wound around one or more guide pulleys 96, a first end of each of the wires 92 to 95 is stuck to coaxially coupled take-up pulleys 97 (97*a* and 97*b* in this example), the take-up pulleys 97 are rotated by a driving motor 98 that is rotatable forward and backward, and the wires 92 to 95 are moved by a predetermined amount to raise or lower the receiving bottom plate 31 while keeping the receiving bottom plate 31 in a horizontal position.

Figure 7:
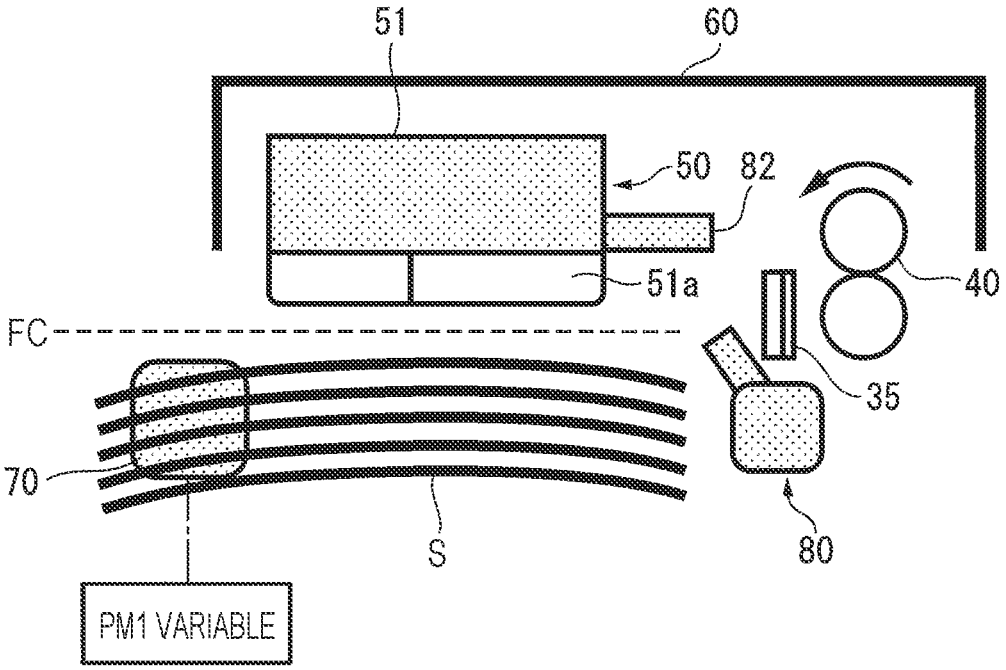
FIG. 7 is a diagram of a related portion of the medium feeding device according to the first exemplary embodiment.

A height sensor 99 sets the surface of one of the media loaded on the receiving bottom plate 31 to a predetermined medium reference height FC (refer to FIG. 7).

The medium reference height FC in this case refers to a position where the uppermost position of the medium is set to be capable of undergoing an air suction operation from the vacuum head 50 on condition that the media S are accommodated in the container 30 in a substantially horizontal position.

Pay-Out Roller

In this example, as illustrated in FIG. 4 and FIG. 7, the discharging rollers 40 include a driving roller 41 that drives to rotate, and a driven roller 42 that is driven to rotate following the rotation of the driving roller 41. The discharging rollers 40 transport a medium while holding the medium at a contact portion between the driving roller 41 and the driven roller 42.

Position Sensor

In the present exemplary embodiment, as illustrated in FIG. 4, a position sensor 45 is disposed downstream from the discharging rollers 40 in the medium discharging direction. This position sensor 45 detects the passage of a medium through a nip area of the discharging rollers 40, and is disposed in a medium passage area. A detection signal from the position sensor 45 notifies the end of the operation of feeding a medium S transported previously, and serves as a trigger of the operation of feeding the subsequent medium S in a successive feeding mode.

Vacuum Head

Figure 8:
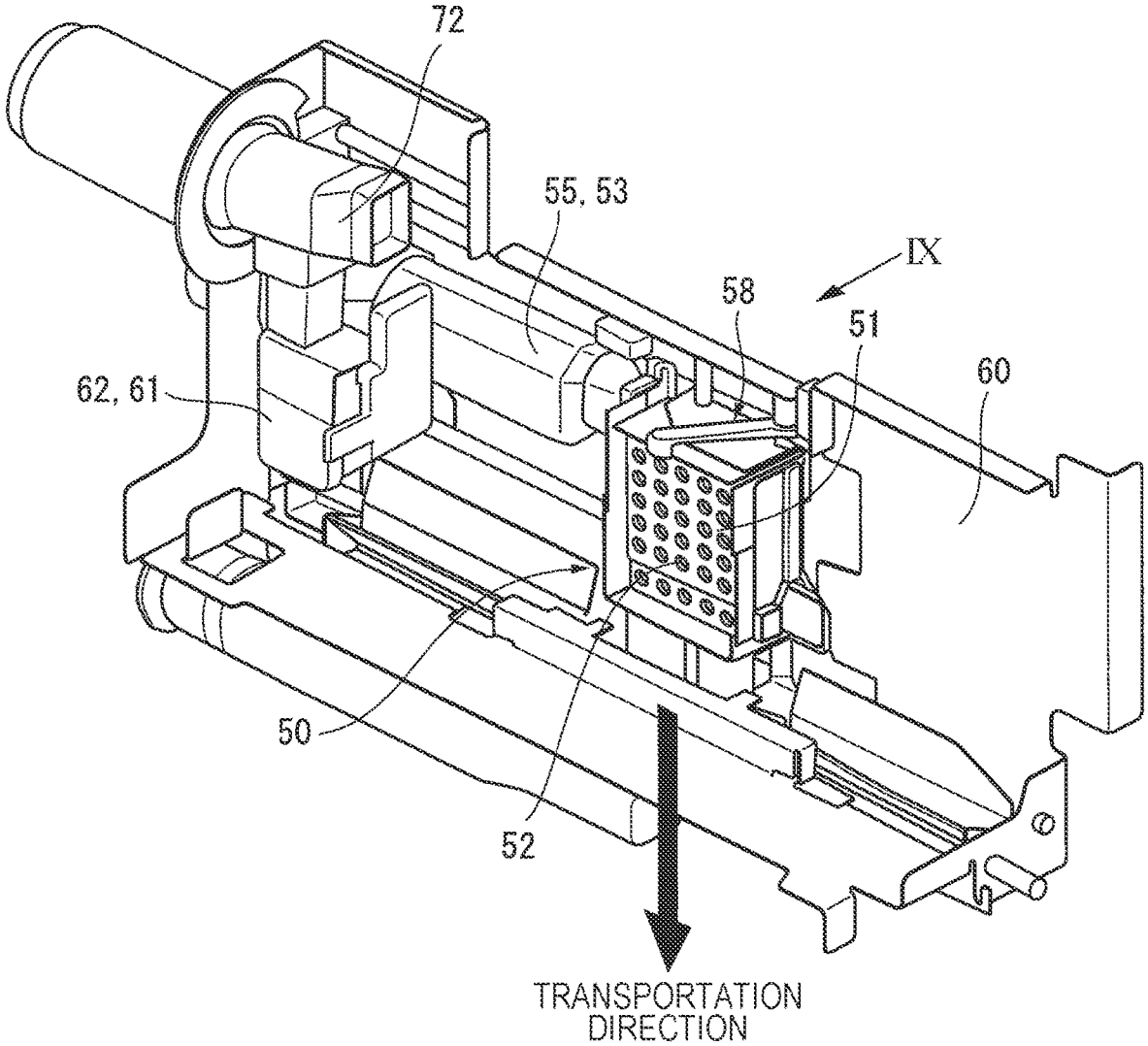
FIG. 8 is a detailed diagram of a vacuum head serving as a hand-over member according to the first exemplary embodiment.

In this example, as illustrated in FIGS. 4, 7, and 8, the vacuum head 50 is supported with a guide mechanism 58 (for example, a guide rod) by a head frame 60 fixed to the housing 12 above the container 30 to be movable forward and rearward in the medium discharging direction.

In this example, the vacuum head 50 includes a hollow box-shaped head body 51. A surface of the head body 51 facing the media accommodated in the container 30 has a large number of vacuum holes 52. The vacuum head 50 also includes a skirt portion 51*a* around the vacuum holes 52 in the head body 51 to keep the medium hermetic while sucking the medium with air.

Figure 10A:
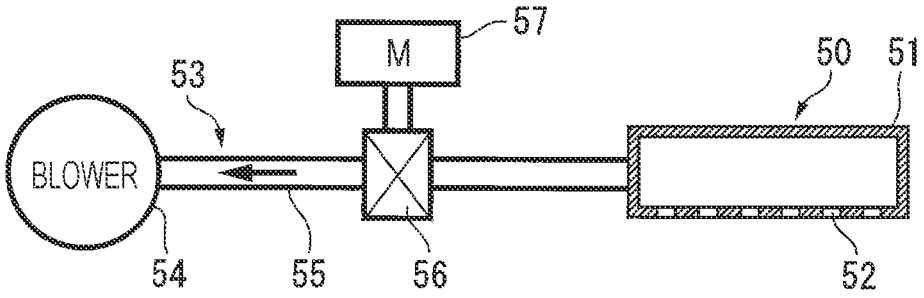
FIGS. 10A and 10B are diagrams of a suction mechanism in the vacuum head, where
Figure 10B:
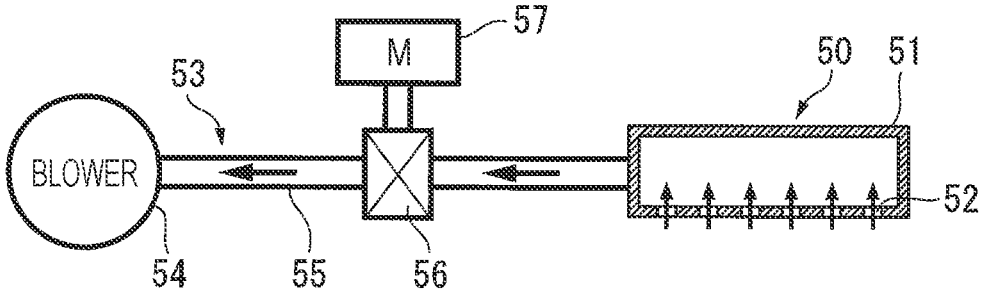

A suction mechanism 53 is connected to the head body 51. As illustrated in FIGS. 10A and 10B, in this case, an example used as the suction mechanism 53 has a structure where a suction blower 54 and the head body 51 are connected with a connection duct 55, an open-close valve 56 that opens and shuts the path is disposed at a portion of the connection duct 55, and the open-close valve 56 is opened or shut by a valve motor 57.

Figure 9:
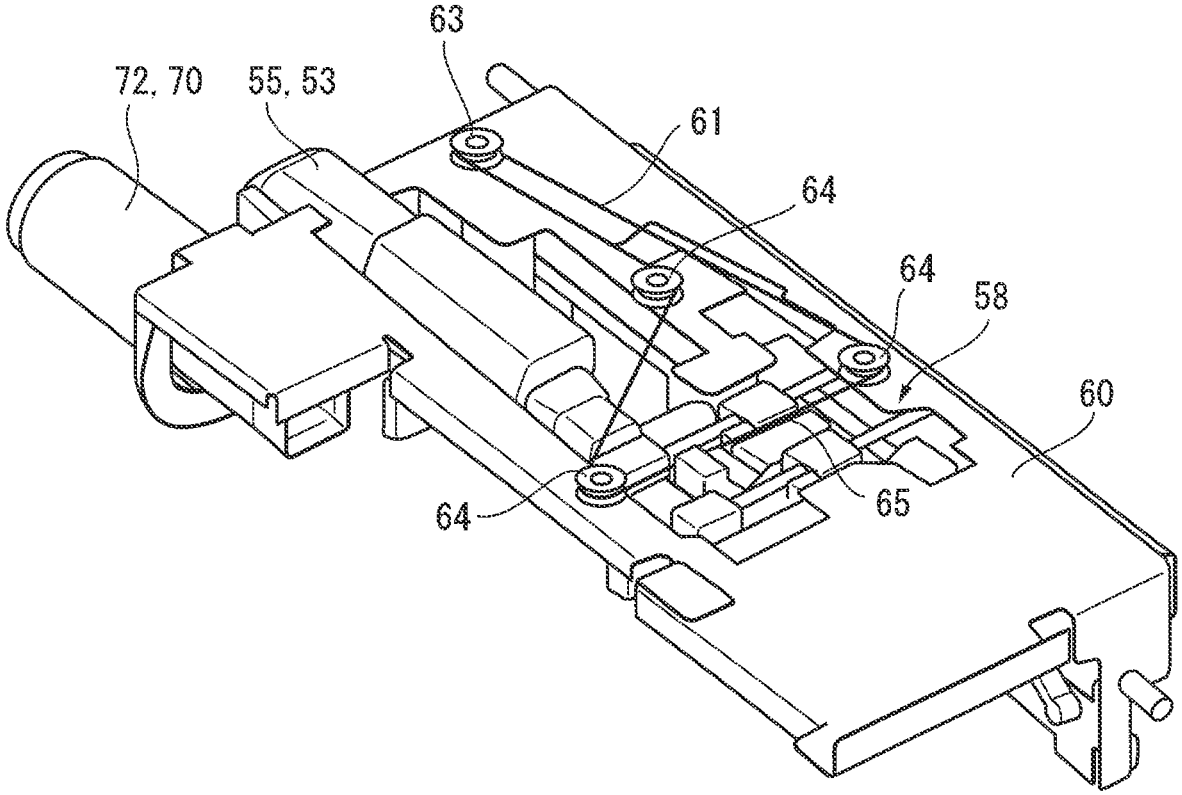
FIG. 9 is a diagram of a forward/rearward moving mechanism of the vacuum head viewed in a direction IX in FIG. 8.

A forward/rearward moving mechanism 61 that moves the vacuum head 50 forward and rearward is disposed at the head frame 60. In this example, as illustrated in FIG. 8 and FIG. 9, the forward/rearward moving mechanism 61 fixes a stepping motor 62 to the head frame 60, a driving pulley 63 is coupled to the stepping motor 62, a predetermined number of transmission pulleys 64 are disposed at the head frame 60 at appropriate positions, a wire 65 is wound around the driving pulley 63 and the transmission pulleys 64, and part of the wire 65 is stuck to the vacuum head 50. In this example, the driving pulley 63 rotates in response to the forward or rearward rotation of the stepping motor 62, the wire 65 moves by a predetermined distance in response, and the vacuum head 50 moves forward or rearward in the medium discharging direction.

Floating Mechanism

In this example, as illustrated in FIGS. 4, 5, 7, and 11, the floating mechanism 70 includes, for example, hollow box-shaped side guides 32 (32*a* and 32*b*). Each side guide 32 has multiple air outlets 71 at an upper portion facing the side of the media, and has, in the hollow portion, an air duct 72 having one end continuous with the corresponding air outlet 71 and the other end continuous with a blower 73 for blowing air. In this case, the blower 73 may be installed inside each side guide 32 or disposed outside of the side guide 32.

An air suction duct 110 in which a heater 111 is installed is connected to the suction port of the blower 73. The temperature inside the air suction duct 110 is detected by a temperature sensor 112. The information from the temperature sensor 112 is taken into a control device 200, and the heater 111 is controlled to be heated with a control signal from the control device 200.

In this example, medium restrictors 100 are disposed near the air outlets 71 of the side guide 32. The medium restrictors 100 in this example are disposed on the side of the media loaded on the receiving bottom plate 31, and protrude to a medium accommodation area to restrict floating excess of media that float while using the floating mechanism 70.

Figure 11:
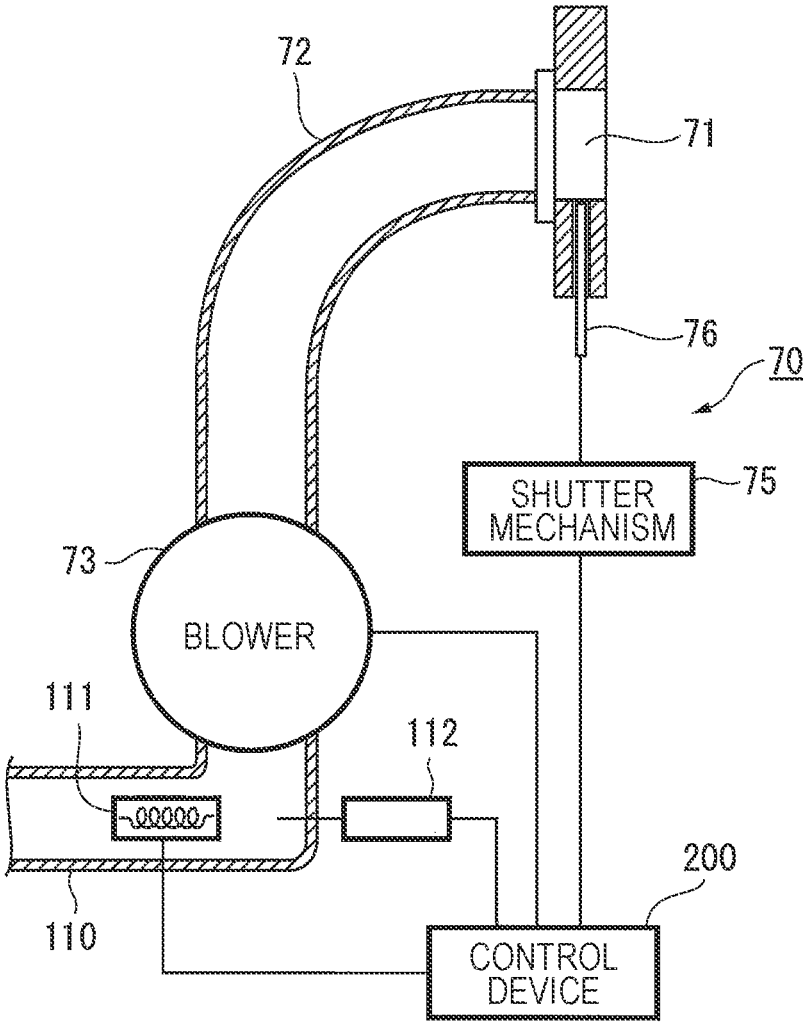
FIG. 11 is a diagram of a floating mechanism illustrated in FIG. 4.
Figure 12B:
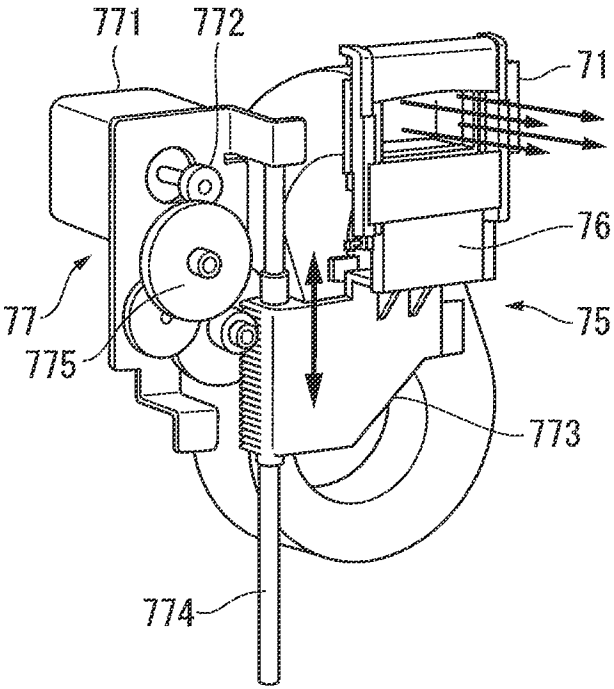
FIGS. 12A and 12B are diagrams of a shutter mechanism included in the floating mechanism, where
Figure 12A:
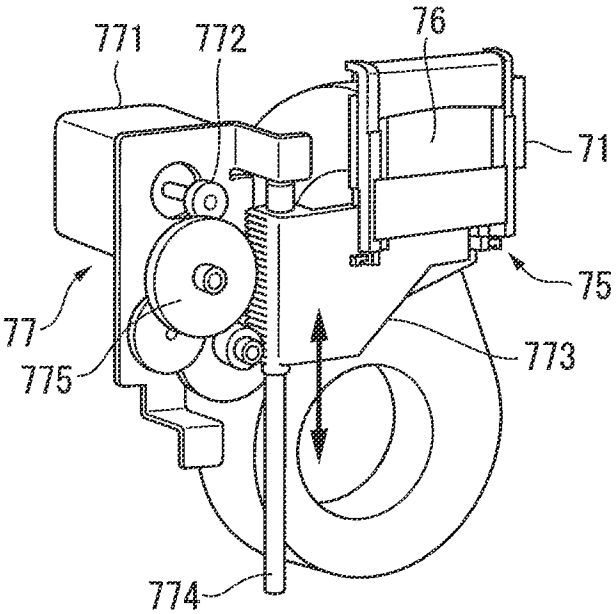

In this example, a shutter mechanism 75 that opens or shuts the air outlets 71 is disposed. As illustrated in FIGS. 11, 12A, and 12B, the shutter mechanism 75 includes a planar shutter 76 covering the air outlet 71 and a shutter driving mechanism 77 that vertically moves the shutter 76 in a reciprocating manner. An example used as the shutter driving mechanism 77 in this case includes a driving motor 771 formed from a stepping motor, a driving transmission gear 772 coaxial with a driving shaft of the driving motor 771, a shutter support member 773 that supports a lower portion of the shutter 76, a rack 774 vertically extending at a side edge of the shutter support member 773, and a driving transmission gear train 775 disposed between the rack 774 and the driving transmission gear 772 to engage the rack 774 and the driving transmission gear 772 with each other to transmit the driving force between the rack 774 and the driving transmission gear 772 via the driving transmission gear train 775. Thus, the driving force from the driving motor 771 driven based on the driving signal from the control device 200 is transmitted to the shutter 76.

Thus, in this example, each air outlet 71 is repeatedly opened and shut by the shutter mechanism 75. Thus, air blown from the air outlets 71 is capable of easily floating the upper portion of the medium S in a fluctuation pattern.

Figure 13A:
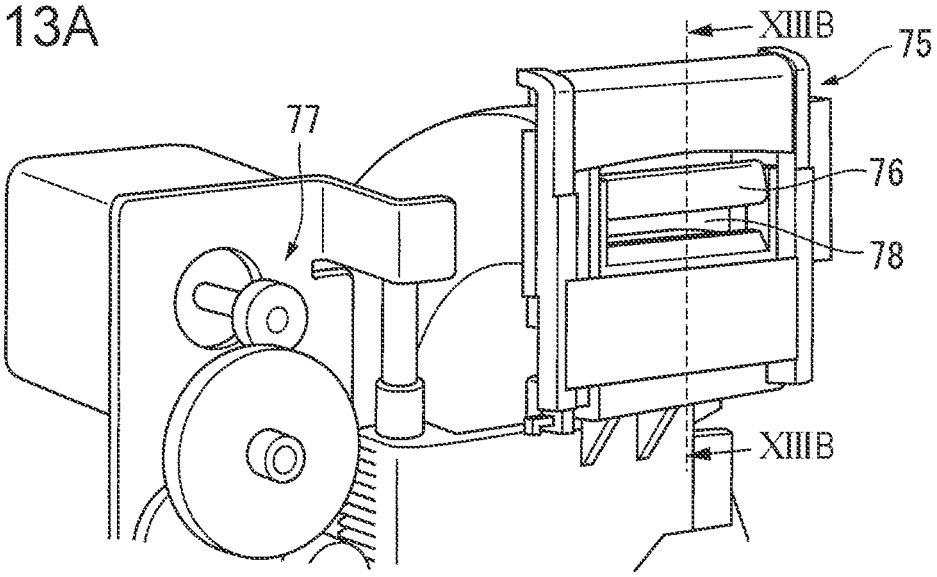
FIGS. 13A, 13B, and 13C are diagrams of the shutter mechanism in FIGS. 12A and 12B, where
Figure 13B:
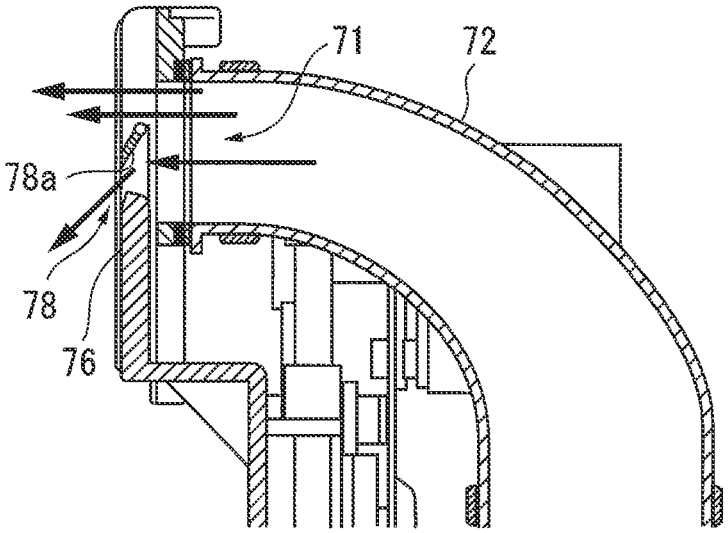

In this example, as illustrated in FIGS. 13A and 13B, the shutter mechanism 75 has a slit 78 in a portion of the shutter 76. At an opening edge of the slit 78, a predetermined inclined portion 78*a* is disposed to direct the direction of air blows blown from the air outlets 71 to obliquely below. Thus, this example is preferable in terms of the effect of separating the media S compared to a structure where the direction of all the air blows is substantially uniformly horizontal.

Figure 13C:
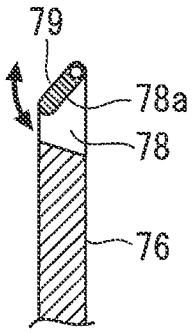
Figure 14A:
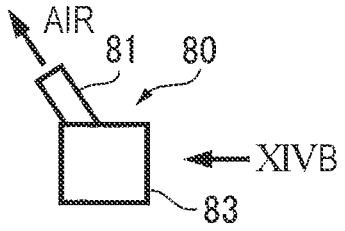
FIG. 14A is a diagram of an air handling mechanism illustrated in FIG. 7.
Figure 14B:
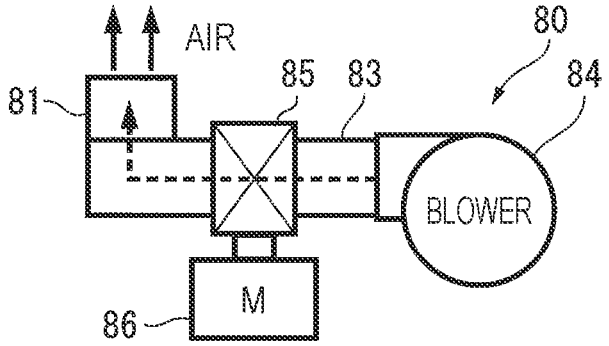
FIG. 14B is a diagram of a state where air is blown when viewed in a direction of arrow XIVB in FIG. 14A.
Figure 14C:
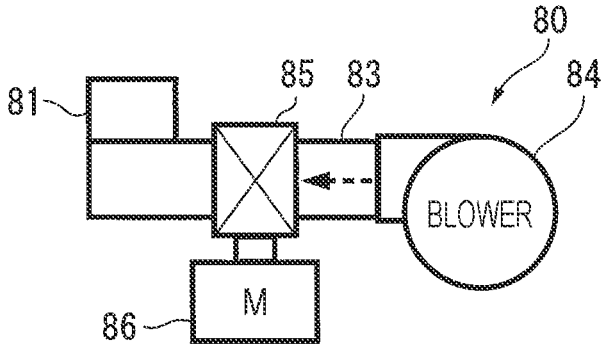
FIG. 14C is a diagram of a state where air is not blown.

As illustrated in, for example, FIG. 13C, to change the inclination angle of the inclined portion 78*a* in the slit 78, the inclined portion 78*a* in the slit 78 in the shutter 76 may be formed from a swingable louver 79 having its angle adjustable. In this case, the pattern of air blows blown from the air outlets 71 is changeable.

Air Handling Mechanism

In this example, as illustrated in FIGS. 4, 7, and 14A to 14C, the air handling mechanism 80 includes an air nozzle 81 that blows knife-shaped air to obliquely rearward from below to the end of the medium floated by the floating mechanism 70 in the discharging direction. An air guide plate 82 protrudes from a portion of the vacuum head 50 closer to the discharging rollers 40 to change the direction of air blown from the air nozzle 81, and to separate the media by blowing air between the upper medium floated by the floating mechanism 70 and the media located below the upper medium.

In this example, the air nozzle 81 is continuous with an air duct 83, to which an air blowing blower 84 is connected. Thus, at a portion of the air duct 83, an open-close valve 85 that opens or shuts the flow path is disposed. The open-close valve 85 is opened or shut by a valve motor 86. Thus, in this example, while the blower 84 is kept driving, air is blown from the air nozzle 81 in a switching manner by opening or shutting the open-close valve 85.

Flotation Detector

In this example, as illustrated in FIGS. 4 and 15A to 15D, the flotation detector 120 is disposed at an upper portion of each side guide 32, and is formed from an imaging device such as a camera. The number of the flotation detector 120 may be at least one, and may be plural.

Figure 15A:
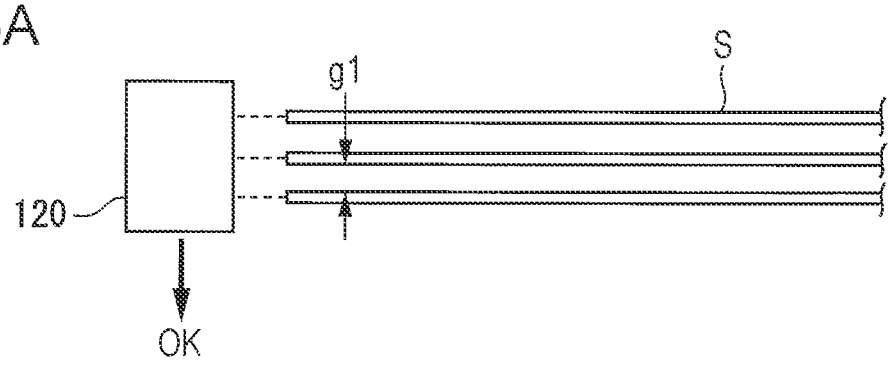
FIG. 15A is a diagram of a detection example where the interval at which the media are floated by the flotation detector is normal.

In this example, as illustrated in FIG. 15A, the flotation detector 120 detects the interval between the floating media S. When an interval g1 is larger than or equal to a predetermined threshold g0 (a level of the medium floating state at which the medium is preferably sucked by the vacuum head 50), the flotation detector 120 determines the floating state of the media S as being preferable (good).

Figure 15B:
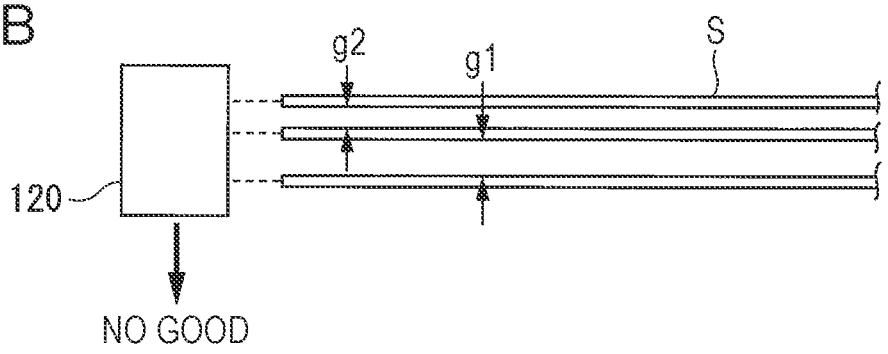
FIG. 15B is a diagram of a detection example where the interval at which the media are floated by the flotation detector is abnormal.

In contrast, as illustrated in FIG. 15B, when an interval g2 between any two of the media S is less than the threshold g0, the flotation detector 120 determines the floating state of the media S as being poor (no good).

In this example, when the interval between the floating media S is larger than or equal to the threshold g0, the flotation detector 120 determines the floating state of the media S as being preferable. Instead, depending on the type of medium (such as a thin paper sheet), a different upper limit threshold may be set to carefully handle the medium considering that the medium S is more likely to float in a poor floating state when the interval exceeds the upper limit threshold.

Figure 15C:
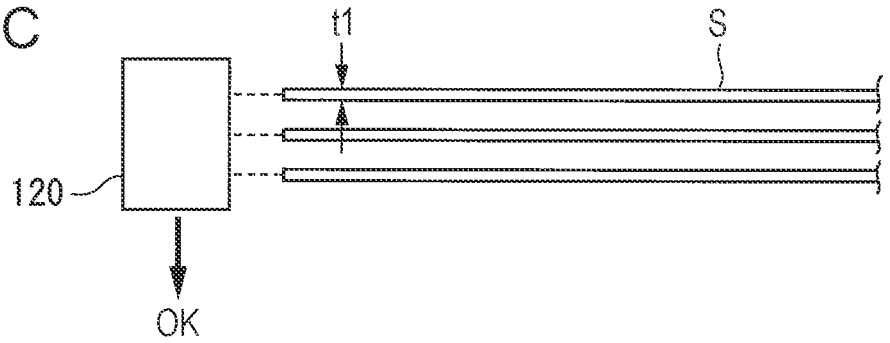
FIG. 15C is a diagram of a detection example where the medium detected by the flotation detector has a normal thickness.

In the exemplary embodiment, the flotation detector 120 detects the interval between the floating media S, but this is not the only possible example. For example, the flotation detector 120 may detect the thickness of the floating media S. In this case, as illustrated in FIG. 15C, when the floating medium S has a thickness t1 of a predetermined threshold t0 (a specified thickness of a medium to be used is selected as the threshold) or smaller, the flotation detector 120 determines that the media S are appropriately separated without being piled together, and thus the flotation detector 120 determines the floating state of the media S as being preferable (good).

Figure 15D:
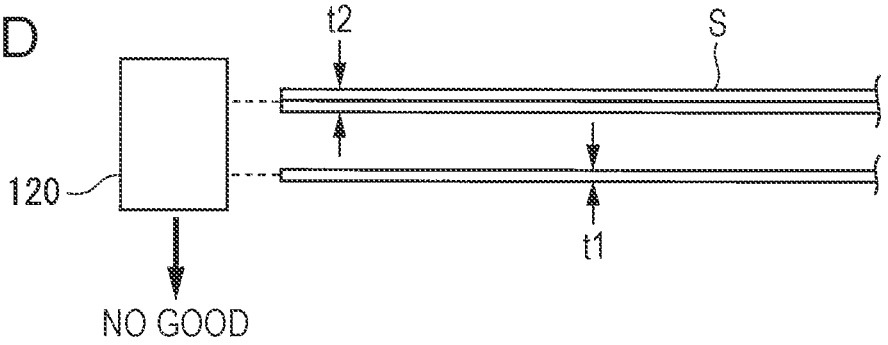
FIG. 15D is a diagram of a detection example where the medium detected by the flotation detector has an abnormal thickness.

In contrast, as illustrated in FIG. 15D, when any of the floating media S has a thickness t2 exceeding the threshold t0, the flotation detector 120 determines that the multiple media S are possibly piled without being separated, and thus the flotation detector 120 determines the floating state of the media S as being poor (no good).

Naturally, both the interval of the media S and the thickness of the media S may be detected.

Control System

As illustrated in FIG. 4, the present example includes the control device 200 that controls the medium feeding device 11. The control device 200 is formed from a microcomputer including various processors. In the embodiments above, the term "processor" refers to a processor in a broad sense. Examples of the processor include general processors (for example, a central processing unit or CPU) and dedicated processors (for example, a graphics processing unit or GPU, an application specific integrated circuit or ASIC, a field programmable gate array or FPGA, and a programmable logic device).

This control device 200 captures, into the processors, various information resulting from, for example, job identification, or signals from various sensors (such as the position sensor 45, the height sensor 99, and the flotation detector 120), executes various programs preinstalled into a memory not illustrated (including an improvement process program of the medium floating state (refer to FIG. 18 to FIG. 20)), and transmits a predetermined control signal to each control target.

In this example, examples of the control target include the discharging rollers 40, the vacuum head 50 (the suction mechanism 53, and the forward/rearward moving mechanism 61), the floating mechanism 70, the air handling mechanism 80, and the hoist mechanism 90. The control device 200 includes a display 210 that displays the processing state of the medium feeding job or a warning indicating an abnormal state in medium feeding.

Medium Feeding Operation Process

First, a basic medium feeding operation process of a medium feeding device according to an exemplary embodiment will be described with reference to FIGS. 16A to 16E.

Figure 16A:
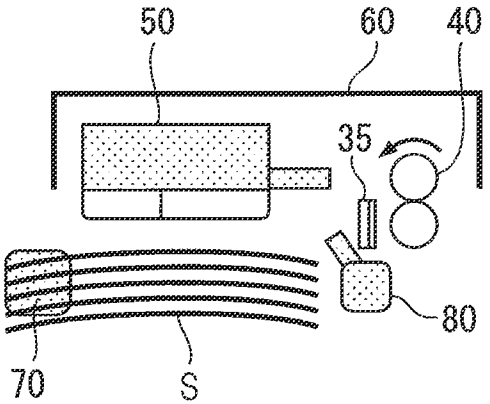
FIGS. 16A to 16E are diagrams of a basic medium feeding operation process performed by the medium feeding device according to the first exemplary embodiment.

First, as illustrated in FIG. 16A, the floating mechanism 70 blows floating air from a side of a medium pile to float some upper sheets in the medium pile to the positions to be sucked by the vacuum head 50 with air.

Figure 16B:
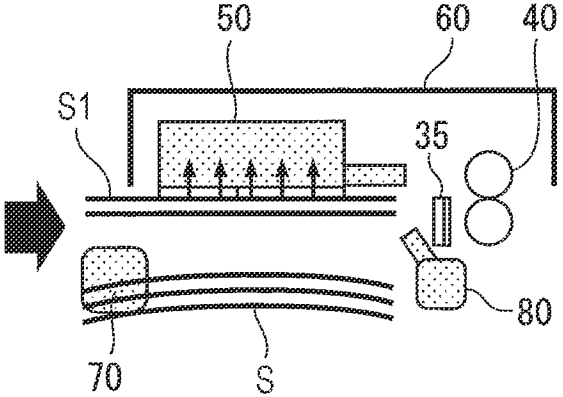

In this state, as illustrated in FIG. 16B, the open-close valve 56 in the suction mechanism 53 in the vacuum head 50 is opened to cause the vacuum head 50 to form a negative pressure. Thus, the vacuum head 50 sucks the floating medium S1 located uppermost with air. At this time, the vacuum head 50 has a recessed portion between the surrounding skirt portion 51*a* and the surfaces of the vacuum holes 52 in the head body 51. Thus, the medium S1 is deformed along the recessed portion, and the skirt portion 51*a* disposed to tightly close the negative pressure area is also raised together with the medium S1.

Figure 16C:
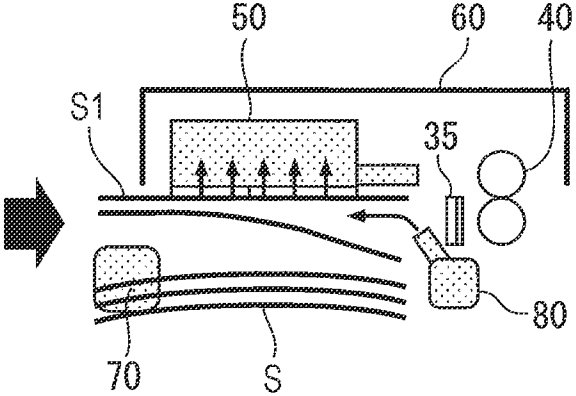

Thereafter, as illustrated in FIG. 16C, the open-close valve 85 in the air handling mechanism 80 is opened, air is applied to the air guide plate 82 located on the side of the vacuum head 50 facing in the discharging direction to insert separating air between an uppermost medium S1 sucked by the vacuum head 50 with air and second and lower media S located below the uppermost medium S1, and the second and lower media S following the uppermost medium S are dropped down with air.

Figure 16D:
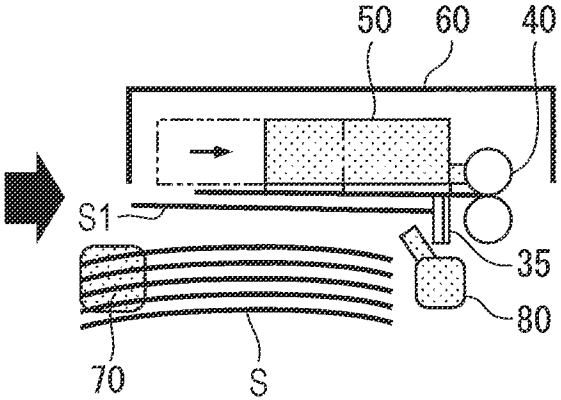

Thereafter, as illustrated in FIG. 16D, the vacuum head 50 holding the uppermost medium S1 moves forward toward the discharging rollers 40, the vacuum head 50 passes the medium S1 to the discharging rollers 40, and then the open-close valve 56 in the vacuum head 50 and the open-close valve 85 in the air handling mechanism 80 are shut.

Figure 16E:
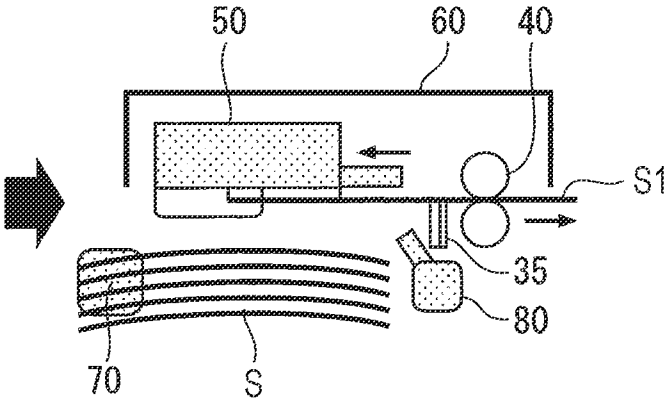

Thereafter, as illustrated in FIG. 16E, the vacuum head 50 is returned to the initial position to be ready for the next medium feeding operation.

<Timing Chart of Each Device>

Figure 17:
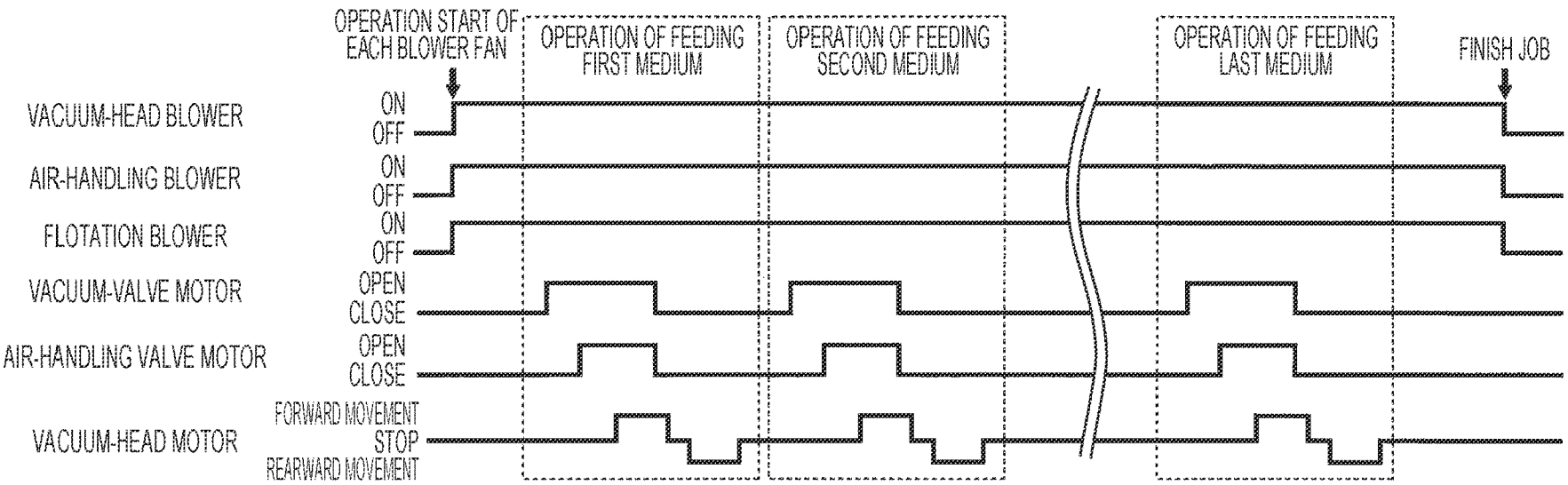
FIG. 17 is a timing chart of a basic medium feeding operation performed by the medium feeding device illustrated in FIGS. 16A to 16E.

FIG. 17 is a timing chart of each device in the above medium feeding operation process.

In FIG. 17, "a vacuum-head blower" corresponds to "the blower 54" (refer to FIGS. 10A and 10B) in the suction mechanism 53, "an air-handling blower" corresponds to "the blower 84" (refer to FIGS. 14A to 14C) in the air handling mechanism 80, and "a flotation blower" corresponds to "the blower 73" (refer to FIG. 11) in the floating mechanism 70.

"A vacuum-valve motor" corresponds to the valve motor 57, "an air-handling valve motor" corresponds to the valve motor 86, and "a vacuum-head motor" corresponds to the stepping motor 62 in the forward/rearward moving mechanism 61.

In this example, "the vacuum-head blower", "the air-handling blower", and "the flotation blower" are kept on during the medium feeding job. "The vacuum-valve motor", "the air-handling valve motor", and "the vacuum-head motor" repeat on/off control for each sheet medium to repeatedly perform suction and forward/rearward movement with the vacuum head 50 and feeding and stopping feeding of separation air from the air handling mechanism 80.

Air Blow Operation Performed by Floating Mechanism

<Pre-Feeding Blowing Operation BL0 and During-Feeding Blowing Operation BL1>

In this example, the floating mechanism 70 performs the air blowing operation (pre-feeding blowing operation BL0) performed before the media S set in the container 30 are fed, and the air blowing operation (during-feeding blowing operation BL1) performed after the start of feeding the media S set in the container 30 until the end of feeding the media A.

Generally, the floating mechanism 70 floats the media S to suck the media S1 with the vacuum head 50 with air for feeding the media S.

In this example, in addition to the above-described during-feeding blowing operation, the floating mechanism 70 performs the above-described pre-feeding blowing operation to separate a pile of the media S set in the container 30 in advance, to preferably float the media S during medium feeding.

Determination of Medium Floating State

In this example, the container 30 raises a pile of the media S loaded on the receiving bottom plate 31 with the hoist mechanism 90 to align the uppermost position of the pile of the media S with the medium reference height FC. During the medium-feeding operation, the loaded media S are sequentially fed. Thus, the pile of the media S in the container 30 is raised by the hoist mechanism 90, and the media S located below in the loaded pile of the media S arrive at a position where the media S are to be floated by the floating mechanism 70, and float with an air blow from the floating mechanism 70. At this time, an upper medium group in the loaded pile of the media S located in an upper area, and a lower medium group in the loaded pile located in a lower area differ in the characteristics such as the paper quality attributable to the humidity or dried state. Thus, the upper medium group and the lower medium group may have a floating state differing from the medium floating state of the previously fed medium S although a predetermined parameter is selected as a floating condition (such as airflow rate of a blow) of the floating mechanism 70. In this manner, keeping the medium feeding operation with the same parameter may lead to an inappropriate separation state (paper jamming or overlapping transport) while the floating mechanism 70 is performing the operation of floating the media S.

In this example, the medium feeding device 11 may be desired to handle various different types of media. Different types of media, for example, a thin paper sheet and a thick paper sheet vary in the medium floating state. For example, when the parameters for the medium-feeding operation (for example, an airflow rate of the floating mechanism 70, an air suction rate of the vacuum head 50, and an air blow rate of the air handling mechanism 80) are set to be suitable for the thick paper sheet, and, for example, when a thin paper sheet is used instead of a thick paper sheet, the parameters for the medium-feeding operation may be inappropriate for the thin paper sheet. In such a case, for example, although a thick paper sheet is floated in a preferable floating state by the floating mechanism 70, a thin paper sheet may be floated in a poor floating state by the floating mechanism 70, and thus may be, for example, unstably sucked and held by the vacuum head 50. Thus, such a parameter setting may interfere with the medium-feeding operation.

Improving Process of Medium-Feeding Operation

Thus, the present exemplary embodiment employs a control method including determining the medium floating state, and, when the medium floating state is inappropriate, changing the parameters for the medium-feeding operation to improve the medium-feeding operation.

In this case, the process of determining the medium floating state is performed in both the pre-feeding blowing operation BL0 and the during-feeding blowing operation BL1.

Figure 18:
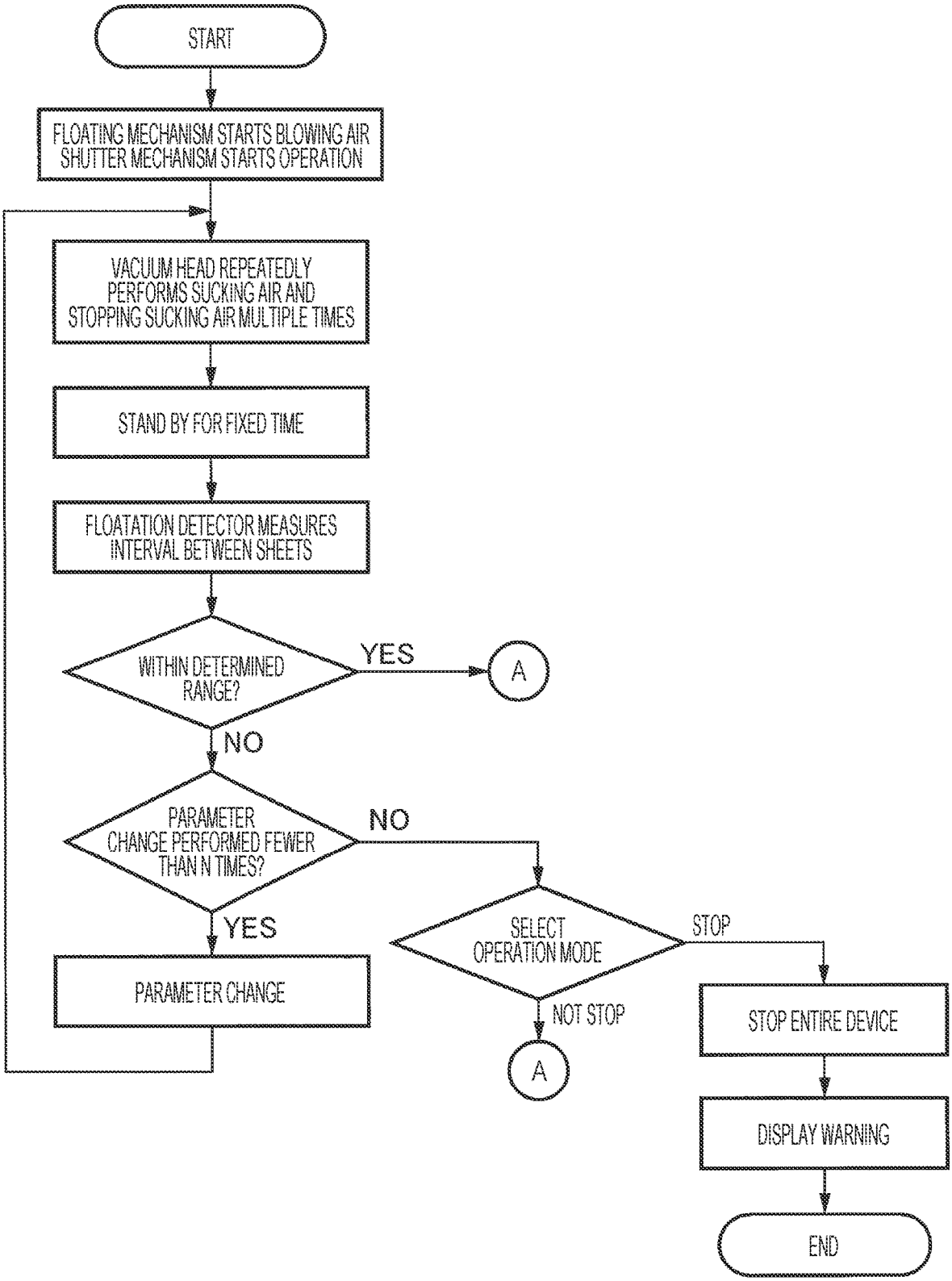
FIG. 18 is a flowchart (1) of a control operation performed by the medium feeding device according to the first exemplary embodiment.
Figure 19:
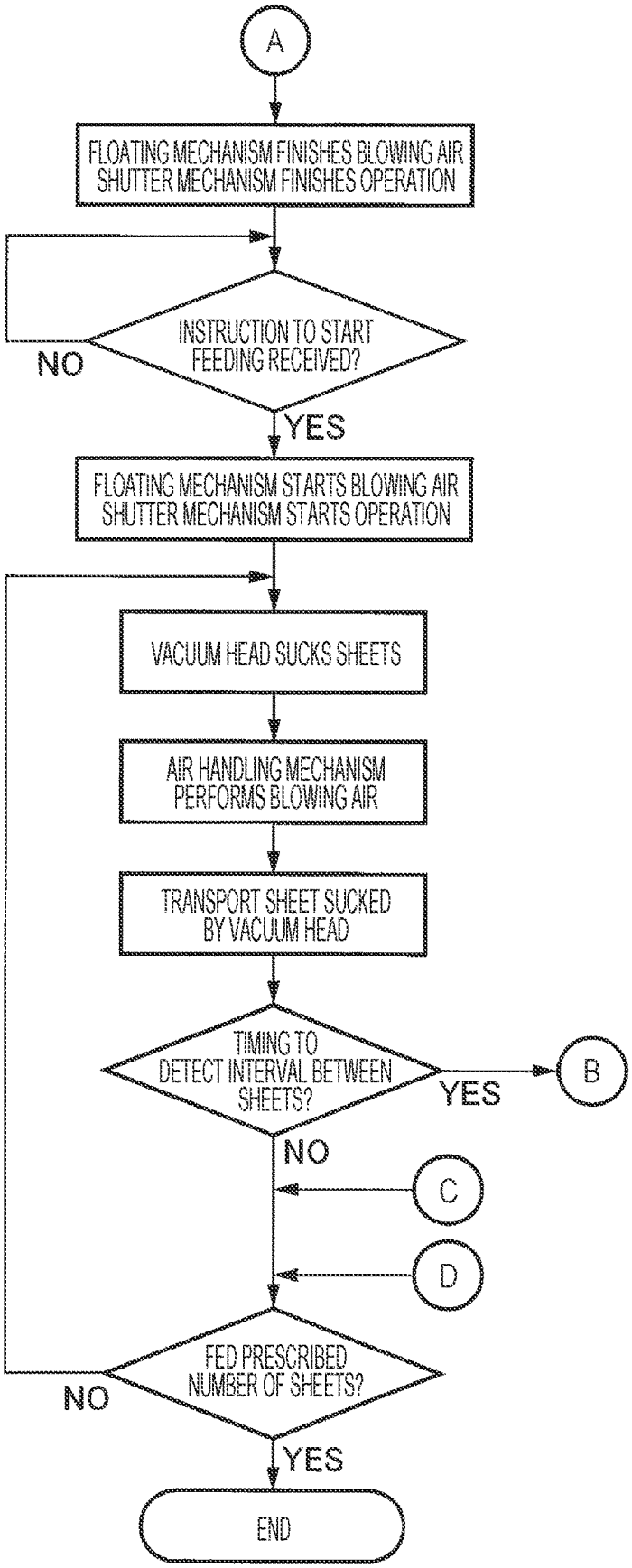
FIG. 19 is a flowchart (2) following the flowchart (1) illustrated in FIG. 18.
Figure 20:
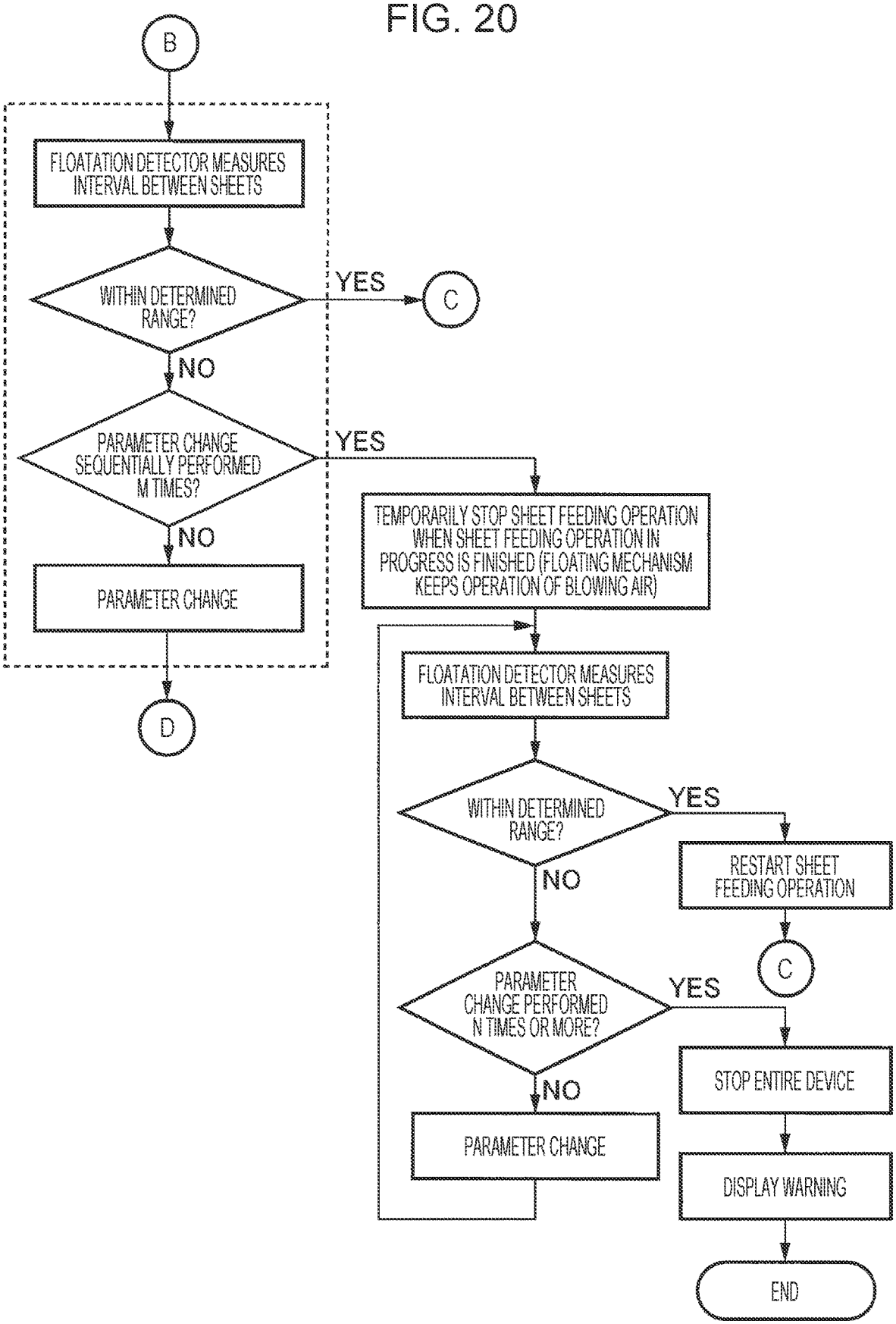
FIG. 20 is a flowchart (3) following the flowchart (2) illustrated in FIG. 19.

FIG. 18 to FIG. 20 are flowcharts of the process of improving the medium-feeding operation according to the present exemplary embodiment.

Process Accompanying Pre-Feeding Blowing Operation BL0

First, in this example, as illustrated in FIG. 18, the process of improving the medium-feeding operation is performed accompanying the pre-feeding blowing operation BL0. In this example, the pre-feeding blowing operation BL0 may be performed only once, or may be performed multiple times at each predetermined time interval (refer to FIG. 21).

More specifically, the floating mechanism 70 (the air outlets 71 and the shutter mechanism 75) performs an air blow as the pre-feeding blowing operation BL0.

In addition, the vacuum head 50 repeatedly performs an operation of sucking air and stopping sucking air multiple times. This operation of the vacuum head 50 of sucking air and stopping sucking air is a dummy operation, but is preferable because this operation repeatedly raises or drops upper media, and provides a disturbance to the medium orientation to facilitate separation of the media with a blow.

<Detection with Flotation Detector>

Thereafter, the flotation detector 120 performs detection (detects an interval between sheets serving as media in this example) after an elapse of predetermined time, and determines whether a result of the detection falls within a determined target range.

In this case, when a result of the detection of the flotation detector 120 exceeds the target range (refer to FIG. 15B), the flotation detector 120 determines that the floating state of the sheet serving as the medium is poor. When a result of the detection of the flotation detector 120 falls within the target range (refer to FIG. 15A), the flotation detector 120 determines that the floating state of the sheet serving as the medium is preferable.

<Change of Parameters>

As described above, when a result of the detection of the flotation detector 120 is out of the target range, the parameter for the medium-feeding operation (corresponding to "the sheet feeding operation") including the pre-feeding blowing operation BL0, or in this example, a parameter PM1 (refer to FIG. 7) for the air blowing operation performed by the floating mechanism 70 is changed.

In this example, an air blow rate from the air outlets 71 selected as an example of the parameter PM1 is changed to be increased because the floating state is determined as being poor due to a narrow interval between the sheets serving as the media.

Instead of the air blow rate, the parameter PM1 may be selected as appropriate from any conditions that affect the operation of floating the media with the floating mechanism 70, for example, the air temperature, an air blowing direction, or an air blowing pattern.

In this case, to change the air temperature, the heating condition of the heater 111 may be changed. To change the air blowing direction or the blowing pattern, the pattern or time of opening or shutting the shutter 76, or the inclination direction of the slit 78 in the shutter 76 may be changed.

<Parameter Change Timing>

Figure 21:
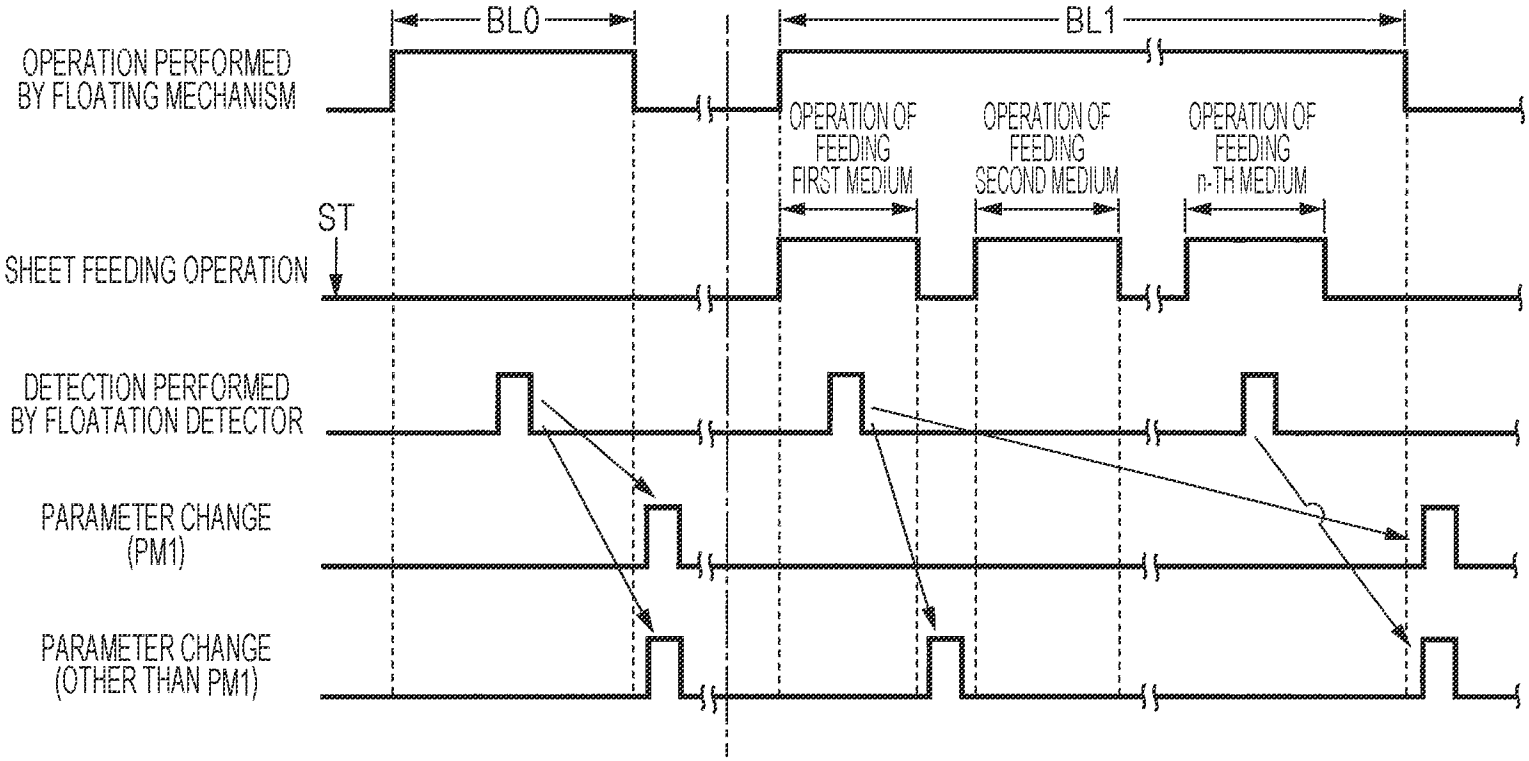
FIG. 21 is a timing chart of a control operation performed in the pre-feeding blowing operation and the during-feeding blowing operation by the floating mechanism.

As illustrated in FIG. 21, the parameter PM1 may be changed at a timing when the pre-feeding blowing operation BL0 is not performed, and the changed parameter PM1 is applied to the next pre-feeding blowing operation BL0.

When the next pre-feeding blowing operation BL0 is not performed, the changed parameter PM1 is applied to the during-feeding blowing operation BL1 performed first in the medium-feeding operation.

<Process of Repeated Change of Parameter>

When the pre-feeding blowing operation BL0 is performed multiple times, and the parameter is changed more than or equal to a predetermined number of times N, the operation mode of the medium feeding device 11 is selected. When a stop operation mode is selected, the entire device is stopped, and the display 210 (refer to FIG. 4) displays a warning.

On the other hand, when a non-stop mode is selected as the operation mode, as illustrated in FIG. 19, the floating mechanism 70 finishes blowing air, and the shutter mechanism 75 finishes the opening and shutting operation. This operation is performed to check the medium floating state again during the medium-feeding operation although an appropriate parameter change is not performed during the pre-feeding blowing operation.

<Case where Parameter is not Changed>

When a result of the detection of the flotation detector 120 is within a target range, no parameter change is performed in particular, and as illustrated in FIG. 19, the floating mechanism 70 finishes blowing air, and the shutter mechanism 75 finishes the opening and shutting operation.

Process Accompanying During-Feeding Blowing Operation BL1

In this example, as illustrated in FIG. 19, a process of improving the medium-feeding operation (sheet feeding operation) is performed accompanying the during-feeding blowing operation BL1. In this example, the during-feeding blowing operation BL1 is performed every time when the medium-feeding operation is performed (refer to FIG. 21).

In FIG. 19, when an instruction to start feeding sheets serving as media is received, the floating mechanism 70 starts blowing air, and the shutter mechanism 75 starts the opening and shutting operation.

Thereafter, the vacuum head 50 sucks the sheets serving as media, the air handling mechanism 80 starts blowing air, and the vacuum head 50 transports the sucked sheets serving as media toward the discharging rollers 40.

Thereafter, whether the timing for the flotation detector 120 to perform detection has come is determined. When the timing for the flotation detector 120 to perform detection has not come yet, the medium-feeding operation is repeated until the number of sheets fed arrives at the prescribed number of sheets.

<Detection with Flotation Detector and Parameter Change>

When the timing for the flotation detector 120 to perform detection has come, as illustrated in FIG. 20, the flotation detector 120 measures the interval between the sheets serving as media to determine whether the interval is within the determined target range.

Thereafter, when the number of times the parameter is changed sequentially fails to arrive at the predetermined prescribed number of times (M times), the parameter is changed (the parameter PM1 is changed in this example) on condition that the parameter is out of the target range (refer to FIG. 21).

In this example, for example, when a job of feeding one sheet is specified, the during-feeding blowing operation BL1 is not finished during the sheet feeding operation. After an elapse of predetermined time after the feeding operation is finished, the during-feeding blowing operation BL1 is temporarily finished. In this manner, the shutter mechanism 75 and the blower 54 in the floating mechanism 70 are controlled to be turned on or off for each sheet feeding job.

However, in this example, when, for example, a job of feeding sequential sheets (n sheets) is specified, the floating mechanism 70 successively performs the during-feeding blowing operation BL1 also during intermittent sheet feeding operations (an operation of feeding a first sheet, an operation of feeding a second sheet, . . . , and an operation of feeding an n-th sheet). Specifically, the job of feeding successive sheets is controlled in such a manner that a time period after one sheet feeding operation is finished and before the floating mechanism 70 is turned off (after-blow time) is set long, and when the next sheet feeding operation is started before the floating mechanism 70 is turned off, turning off the air blowing operation of the floating mechanism 70 is cancelled. Thus, the floating mechanism 70 successively performs the during-feeding blowing operation BL1, and the floating mechanism 70 stably performs the operation of floating the media during the job of feeding successive sheets.

Thus, in this example, as illustrated in FIG. 21, for both the job of feeding one sheet each and the job of feeding successive sheets, the floating mechanism 70 changes the parameter PM1 when the floating mechanism 70 is not performing the during-feeding blowing operation BL1.

Regardless of when a control method of temporarily finishing the during-feeding blowing operation BL1 in a time period between feeding operations in a job of feeding successive sheets is employed, the floating mechanism 70 may naturally change the parameter PM1 in the time period between the feeding operations.

As illustrated in FIG. 21, the changed parameter is used in the next during-feeding blowing operation BL1.

<Case where Parameter is not Changed>

When a result of the detection of the flotation detector 120 is within the determined target range, the process returns to C in FIG. 19, and the medium-feeding operation is performed until the number of sheets fed arrives at the prescribed number of sheets.

<Process of Repeatedly Changing Parameter>

In FIG. 20, when the parameter change successively arrives at the prescribed number of times (M times), the sheet feeding operation is temporarily stopped when the medium-feeding operation (sheet feeding operation) in progress is finished. However, the floating mechanism 70 keeps the operation of blowing air.

Thereafter, the flotation detector 120 measures the interval between the sheets serving as media, and determines whether the interval is within the determined target range. When the interval is within the determined target range, the flotation detector 120 restarts the sheet feeding operation, and then, as illustrated in FIG. 19, performs the sheet feeding operation until the number of sheets fed arrives at the prescribed number of sheets.

When a result of the detection of the flotation detector 120 fails to fall within the determined target range, the parameter change is performed on condition that the number of times the parameter is changed has not arrived at the prescribed number of times (N times).

In contrast, when the parameter change is performed more than or equal to N times, the entire device is stopped and the display 210 (refer to FIG. 4) displays a warning.

Second Exemplary Embodiment

Figure 22:
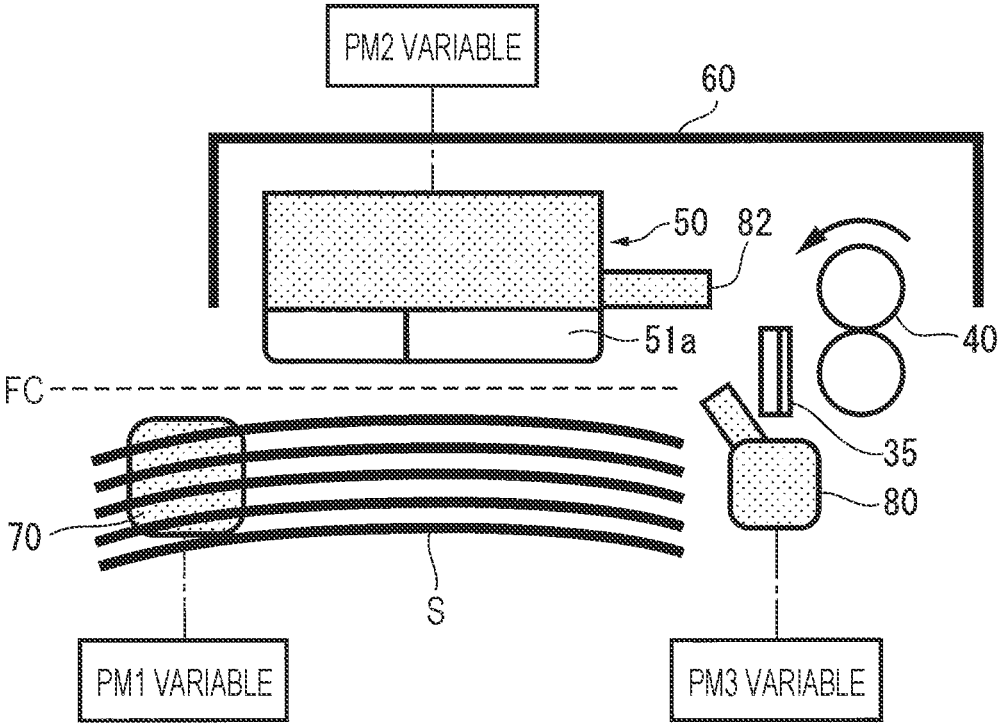
FIG. 22 is a diagram of a related portion of a medium feeding device according to a second exemplary embodiment.

FIG. 22 illustrates a related portion of a medium feeding device according to the second exemplary embodiment.

In FIG. 22, the medium feeding device 11 has a basic structure substantially the same as that of the first exemplary embodiment, but differs from the first exemplary embodiment in parameters for the medium-feeding operation that are to be changed when a result of the detection of the flotation detector 120 deviates from the predetermined target range.

In this example, in addition to the parameter (PM1) for the air blowing operation performed by the floating mechanism 70, a parameter (PM2) for the air suction operation performed by the vacuum head 50 and a parameter (PM3) for the air blowing operation performed by the air handling mechanism 80 are to be changed.

In this example, the air suction operation performed by the vacuum head 50 and the air blowing operation performed by the air handling mechanism 80 are intermittently performed for each medium-feeding operation (corresponding to "the sheet feeding operation" in FIG. 21). Thus, as illustrated in, for example, FIG. 21, the parameters PM2 and PM3 for these operations are changed when the medium-feeding operation is not intermittently performed (for example, in a time period during the medium-feeding operation not intermittently performed or in the time period between the medium-feeding operations).

<Parameter PM1>

In this example, the parameter PM1 of the floating mechanism 70 is similar to that in the first exemplary embodiment.

<Parameter PM2>

Examples of the parameter PM2 of the vacuum head 50 include an air suction rate of the vacuum head 50.

Figure 23:
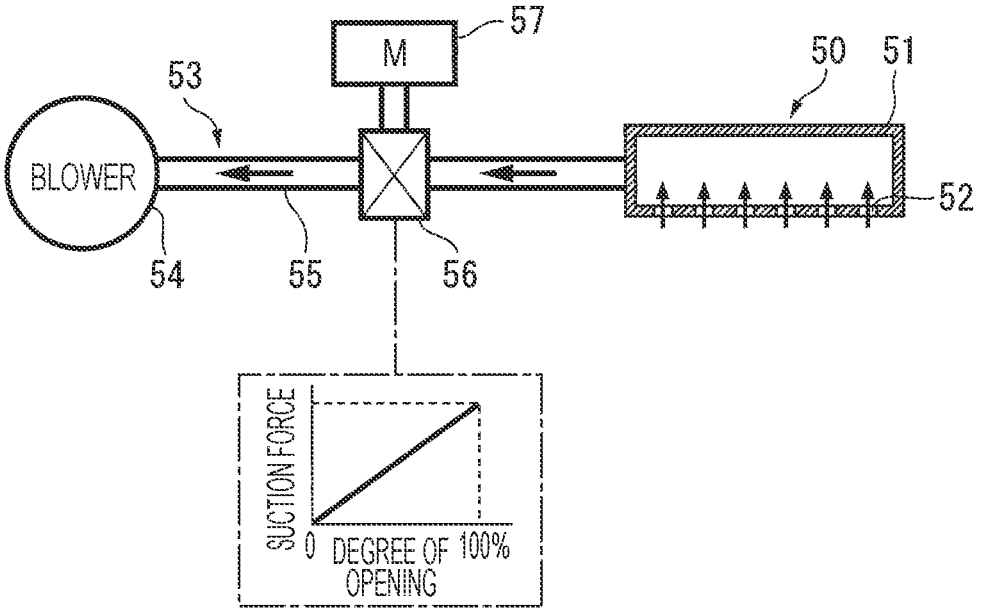
FIG. 23 is a diagram of an example where the parameter of the vacuum head according to the second exemplary embodiment is variable.

In this case, for example, as illustrated in FIG. 23, the degree of opening of the open-close valve 56 in the suction mechanism 53 in the vacuum head 50 is adjustable successively or stepwise, and the degree of opening of the open-close valve 56 is changeable with the valve motor 57.

For example, when the medium is floated by the floating mechanism 70 in a poor floating state, the air suction rate may be increased to enhance the suction force of the vacuum head 50 to suck the medium.

As another example of changing the air suction rate of the vacuum head 50, the open-close valve 56 may be opened or shut by being turned on or off to change the number of rotations of the blower 84.

Other examples of the parameter PM2 include the time length for which and the start timing at which the vacuum head 50 performs air suction.

<Parameter PM3>

Examples of the parameter PM3 of the air handling mechanism 80 include an air blow rate from the air nozzle 81, an air blow area, and an air blowing direction.

Figure 24A:
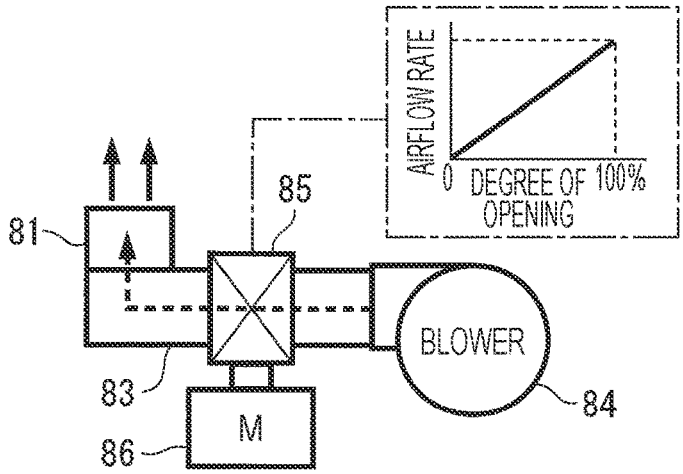
FIG. 24A is a diagram of an example where the air blow rate serving as a parameter of an air handling mechanism according to a second exemplary embodiment is variable.

In this case, as illustrated in, for example, FIG. 24A, "the air blow rate" from the air nozzle 81 is changeable by changing, with the valve motor 86, the degree of opening of the open-close valve 85 in the air handling mechanism 80 that is adjustable successively or stepwise.

For example, when the media are selectively used between the thick paper sheets and the thin paper sheets, changing the air blow rate from the air nozzle 81 in accordance with the type of media is effective.

As another example of changing the air blow rate, the open-close valve 85 may be opened or shut by being turned on or off to change the number of rotations of the blower 84.

Figure 24B:
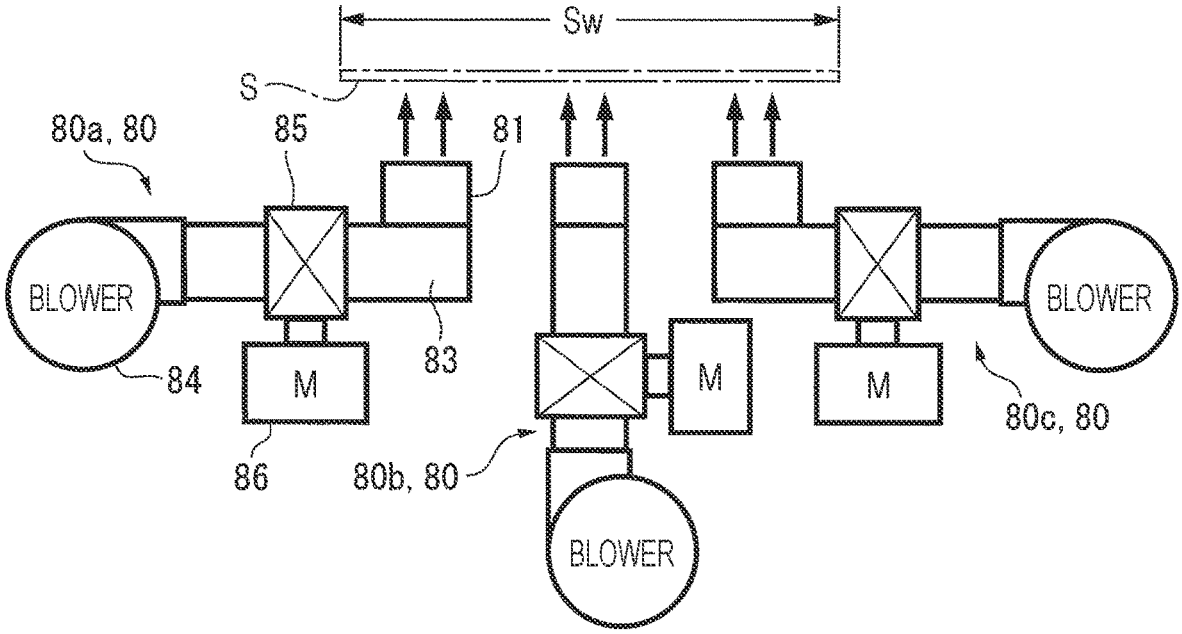
FIG. 24B is a diagram of an example where the air blow area serving as a parameter of the air handling mechanism is variable.

As illustrated in, for example, FIG. 24B, "the air blow area" may be changed by arranging one or more sets of multiple (three in this example) air handling mechanisms 80 (more specifically, 80*a* to 80*c*) to orient the respective blow areas toward a blown area Sw of the medium S.

Figure 25A:
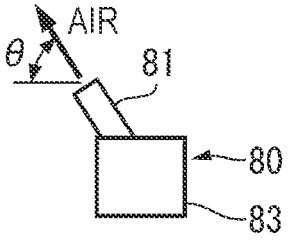
FIG. 25A is a diagram of an example where the air blowing direction serving as a parameter of the air handling mechanism according to the second exemplary embodiment is variable.
Figure 25B:
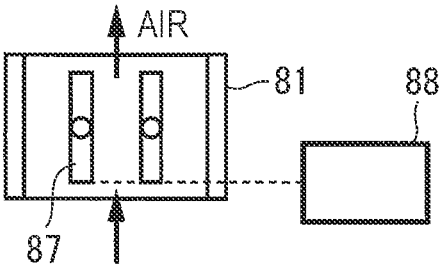
FIG. 25B is a diagram of a structure example 1 where the air blowing direction illustrated in FIG. 25A is variable.
Figure 25C:
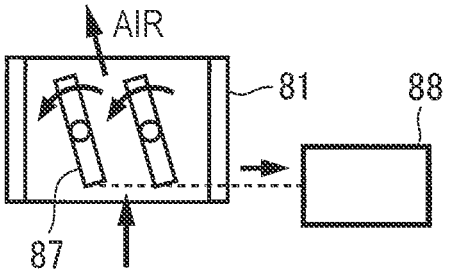
FIG. 25C is a diagram illustrating an operation performed to make the air blowing direction variable in the structure example 1 illustrated in FIG. 25B.

In addition, for example, as illustrated in FIG. 25A to 25C, "the air blowing direction" or an air blowing direction θ (an angle with respect to the horizon) from the air nozzle 81 is changeable by swingably disposing a louver 87 for restricting the air direction in, for example, the air nozzle 81, and changing the direction of the louver 87 that is drivable by an actuator 88 such as a solenoid.

Figure 25D:
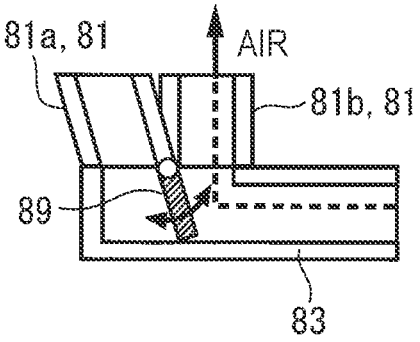
FIG. 25D is a diagram of a structure example 2 where the air blowing direction illustrated in FIG. 25A is variable.
Figure 25E:
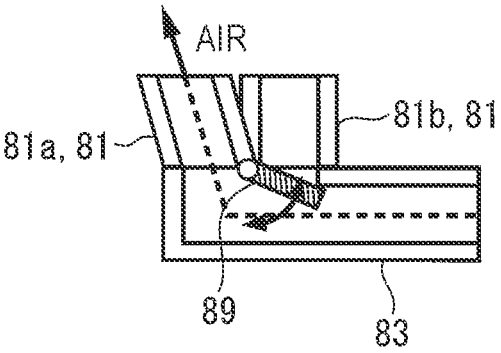
FIG. 25E is a diagram illustrating an operation performed to make the air blowing direction variable in the structure example 2 illustrated in FIG. 25D.

As illustrated in FIGS. 25A, 25D, and 25E, another example for changing "the air blow direction" is to connect, to the air duct 83, two air nozzles 81 (more specifically, 81*a* and 81*b*) that blow air in different directions, disposing a switching valve 89 at a connection portion of the air duct 83 continuous to the two air nozzles 81 (81*a* and 81*b*), switching this switching valve 89 to be securely connected to either one of the air nozzles 81 (81*a* and 81*b*) to select the air nozzle 81 (81*a* or 81*b*) in a switching manner.

In the present exemplary embodiment, in the parameter change, three parameters PM1 to PM3 are changed, but this is not the only possible example. For example, two parameters PM1 and PM2, two parameters PM1 and PM3, or two parameters PM2 and PM3 may be changed, or, only the parameter PM2 or PM3 may be changed instead of the parameter PM1.

Third Exemplary Embodiment

Figure 26:
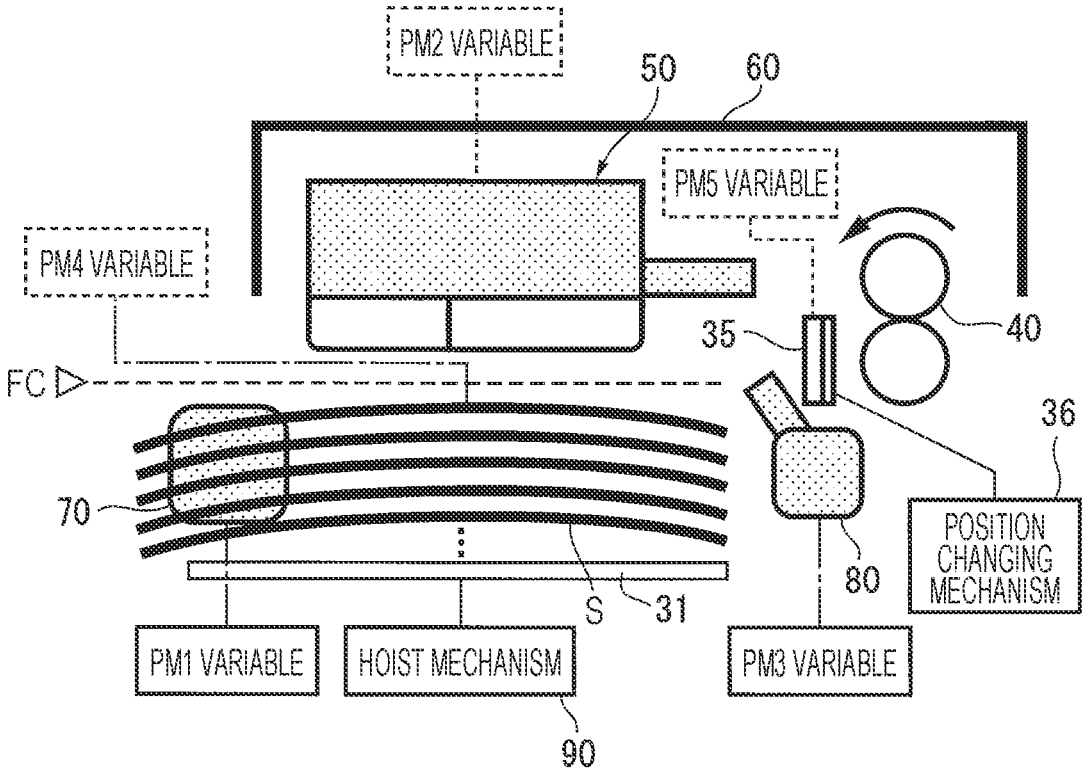
FIG. 26 is a diagram of a related portion of a medium feeding device according to a third exemplary embodiment.

FIG. 26 illustrates a related portion of a medium feeding device according to a third exemplary embodiment.

In FIG. 26, the medium feeding device 11 has substantially the same basic structure as the first and second exemplary embodiments, but differs from the first and second exemplary embodiments in the parameters for the medium-feeding operation to be changed when a result of the detection of the flotation detector 120 deviates from the predetermined target range.

In this example, in addition to the parameters (PM1, PM2, and PM3) to be changed in the second exemplary embodiment, a parameter (PM4, corresponding to the medium reference height FC) for the height position of the pile of the media S loaded on the container 30, and a parameter (PM5) for the upper end position of the separation plate 35 are selected.

In this example, the height adjustment of the pile of the media S loaded on the container 30 and the adjustment of the vertical position of the separation plate 35 are intermittently performed for each medium-feeding operation (corresponding to "the sheet feeding operation" in FIG. 21). Thus, as illustrated in, for example, FIG. 21, the parameters PM4 and PM5 for these operations are changed at a timing when the medium-feeding operation is not intermittently performed (for example, in the time period during the medium-feeding operation not intermittently performed or in the time period between the medium-feeding operations).

<Parameter PM4>

Figure 27A:
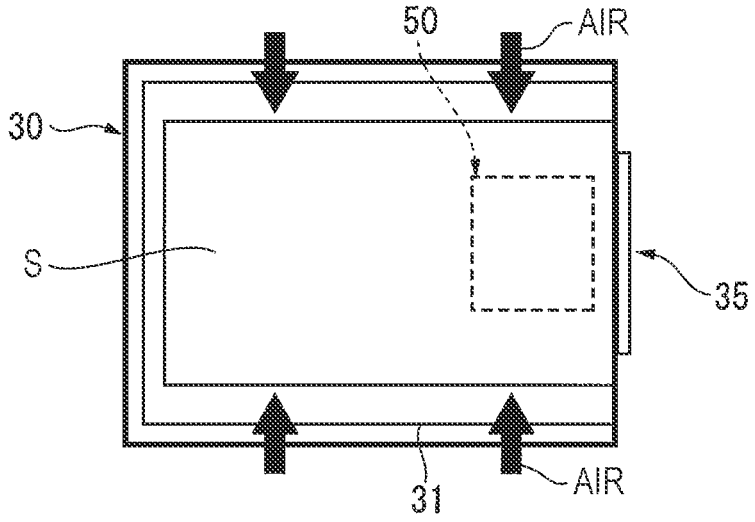
FIG. 27A is a schematic plan view of a layout around a container.
Figure 27B:
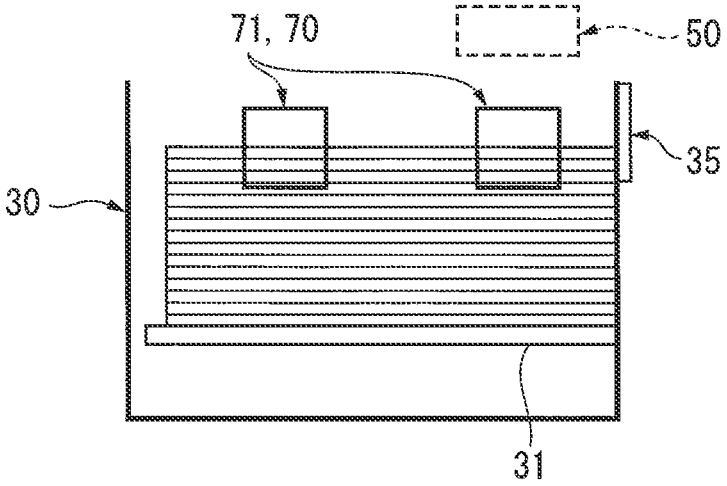
FIG. 27B is a front view of the layout.

In this example, as illustrated in FIGS. 27A and 27B, the medium feeding device 11 appropriately raises or lowers the receiving bottom plate 31 with the hoist mechanism 90 to change the uppermost position of the pile of the media S loaded on the receiving bottom plate 31, that is, the height position of the pile of the media S.

In this case, the height position of the pile of the media S is normally adjusted to correspond to the medium reference height FC. However, when the height position of the pile of the media S facing the air outlets 71 of the floating mechanism 70 is changed, the number of media accommodated in the area facing the air outlets 71 is changed, and thus the number of media separated by the air blown from the air outlets 71 is changed. Thus, the floating state of the media S is changed.

In this example, the flotation detector 120 performs detection (measures the interval between the sheets serving as media), and determines whether a result of the detection is within a predetermined target range.

Figure 28A:
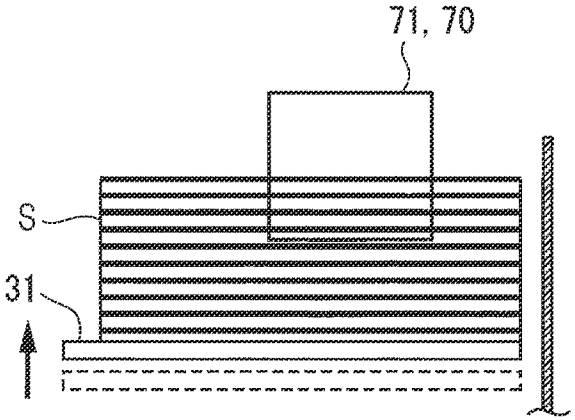
FIGS. 28A to 28D are diagrams illustrating a change of a parameter PM4 (medium reference height)

In this example, the target range indicates the range between the upper-limit threshold and the lower-limit threshold. For example, in an assumption that the interval between the sheets serving as media in the floating state is larger than the target range, as illustrated in FIG. 28A, the position of the receiving bottom plate 31 may be raised to raise the height position of the pile of the media to change the parameter PM4.

Figure 28B:
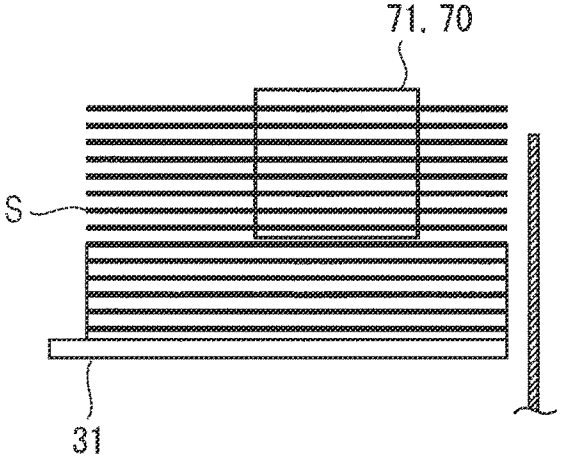

At this time, the sheets are separated by a surplus distance. Thus, as illustrated in FIG. 28B, when the number of sheets facing the air outlets 71 is increased, the number of sheets that receive an air blow is increased, and the number of sheets to be floated and separated is thus increased.

Figure 28C:
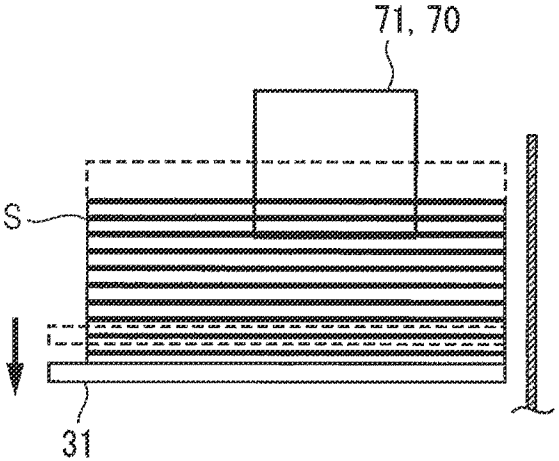

In contrast, when the interval between the sheets serving as media is smaller than the target range, the sheets may be transported while overlapping each other. Thus, as illustrated in FIG. 28C, the position of the receiving bottom plate 31 may be lowered to lower the height position of the pile of the media to change the parameter PM4.

Figure 28D:
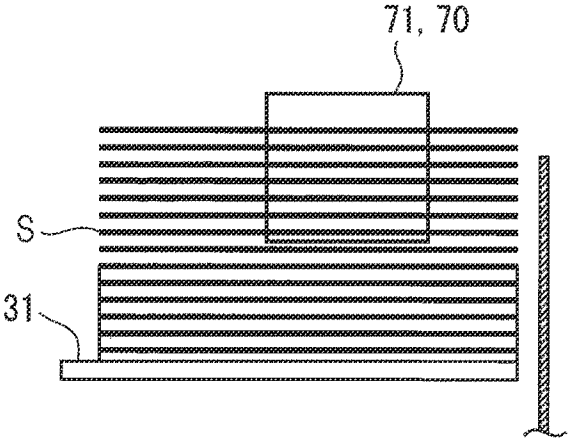

In this case, as illustrated in FIG. 28D, decreasing the number of sheets facing the air outlets 71 allows reduction of the number of sheets receiving an air blow, and reduction of the number of sheets to be floated and separated.

<Parameter PM5>

Figure 29A:
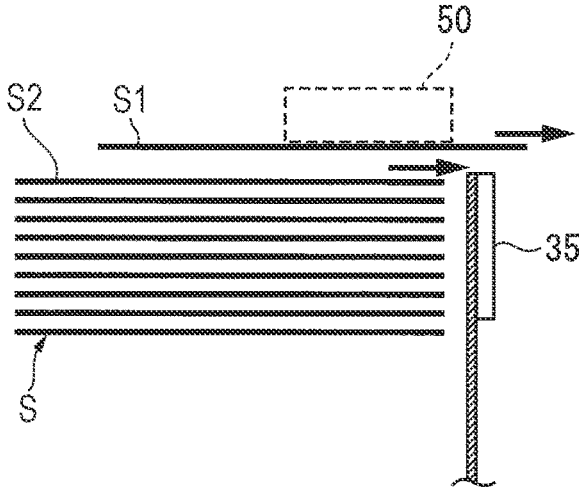
FIGS. 29A to 29C are diagrams illustrating a change of a parameter PM5 (a vertical position of a separation plate), where

In this example, as illustrated in FIGS. 26, 27A, and 27B, the medium feeding device 11 includes the separation plate 35 in front of a contact area (nip area) of the discharging rollers 40. As illustrated in FIG. 29A, the separation plate 35 prevents overlapping transport, or a phenomenon where a sheet S1 transported while being sucked and held by the vacuum head 50 and a sheet S2 located below the sheet S1 are transported together.

In this case, as illustrated in FIG. 29A, when the upper end position of the separation plate 35 is low, the overlapping transport is highly likely to occur. In contrast, when the upper end position of the separation plate 35 is high, the sheet to be fed is more likely to cause collision and paper jamming.

In this example, as illustrated in FIG. 26, the separation plate 35 is supported by a position changing mechanism 36. This position changing mechanism 36 is formed from, for example, an actuator that moves in the vertical direction to change the vertical position of the separation plate 35.

Also in this example, the flotation detector 120 performs detection (measures the interval between the sheets serving as media), and determines whether a result of the detection falls within the predetermined target range.

Figure 29B:
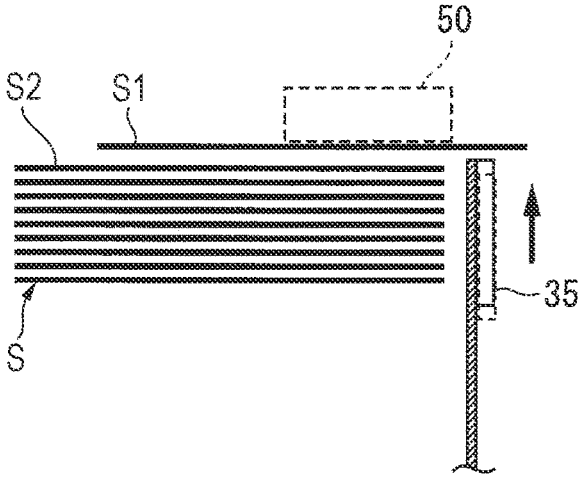

In this example, the target range indicates the range between the upper-limit threshold and the lower-limit threshold. For example, when the interval between the sheets serving as media in the floating state is smaller than the target range, the upper end position of the separation plate 35 may be raised to change the parameter PM5 as illustrated in FIG. 29B.

In this case, the lower sheet S2 highly likely to cause overlapping transport is easily blocked.

Figure 29C:
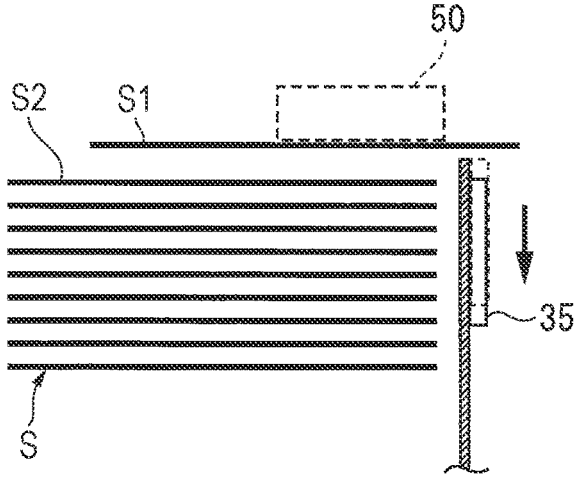

In contrast, when the interval between the sheets serving as media in the floating state is larger than the target range, the upper end position of the separation plate 35 may be lowered to change the parameter PM5 as illustrated in FIG. 29C.

At this time, the lower sheet S2 is more easily blocked. Thus, the sheet S1 that is to be provided may be allowed to flow more easily to less easily cause paper jamming.

In the present exemplary embodiment, the five parameters PM1 to PM5 are changed in the parameter change, but this is not the only possible example. Two, three, or four parameters including the parameter PM4 or PM5 may be changed. Instead, only the parameter PM4 or PM5 may be changed.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A medium feeding device, comprising:

a container member that accommodates sheet media;

a discharging member located further than the media accommodated in the container member in a discharging direction in which the media are discharged, to discharge the media one by one;

a hand-over member disposed above the container member to suck the media accommodated in the container member with air and pass the media to the discharging member;

a floating device disposed on a side of the media accommodated in the container member to blow air to an upper area of a side end surface of the media to float the media while an upper portion of the media is separated;

a detector that detects a separation state of the medium floated by the floating device; and a controller that controls a medium-feeding operation including a pre-feeding blowing operation and a during-feeding blowing operation, the pre-feeding blowing operation serving as an air blowing operation performed by the floating device before the medium is fed, and the during-feeding blowing operation serving as an air blowing operation performed by the floating device from a start of feeding the medium to an end of feeding the medium, wherein after the media are feedably accommodated in the container member and while performing the pre-feeding blowing operation and the during-feeding blowing operation, the controller performs detection with the detector, and on condition that a result of the detection fails to satisfy a preset target range, the controller changes a parameter for the medium-feeding operation including at least one of the pre-feeding blowing operation or the during-feeding blowing operation, wherein the detector detects a thickness of each of the media floating within a detection area, wherein the target range corresponds to no medium having a thickness larger than a predetermined range, wherein the target range is set variable with information of a type of the media, wherein the controller counts a number of times the controller changes the parameter, and wherein if the result of the detection fails to satisfy the preset target range and the number of times is equal to or more than a predetermined number of times, the predetermined number of times being more than one, the controller controls the medium feeding device so as to change an operation mode thereof.

2. The medium feeding device according to claim 1, wherein after the media are feedably accommodated in the container member and at a time point when a predetermined time elapses from a start of the pre-feeding blowing operation while the pre-feeding blowing operation is performed, the controller performs detection with the detector, and on condition that a result of the detection fails to satisfy the preset target range, the controller changes the parameter for the medium-feeding operation including at least the pre-feeding blowing operation.

3. The medium feeding device according to claim 2, wherein on condition that the controller has changed the parameter after performing detection with the detector while the pre-feeding blowing operation is performed, the controller performs detection with the detector again on the pre-feeding blowing operation performed using the parameter previously changed while the pre-feeding blowing operation is performed after an elapse of predetermined time, and on condition that a result of the detection fails to satisfy the preset target range, the controller changes the parameter for the medium-feeding operation including at least the pre-feeding blowing operation.

4. The medium feeding device according to claim 1, wherein after the media are feedably accommodated in the container member and while the during-feeding blowing operation is performed, the controller performs detection with the detector at a predetermined time interval, and on condition that a result of the detection fails to satisfy the preset target range, the controller changes the parameter for the medium-feeding operation including at least the during-feeding blowing operation.

5. The medium feeding device according to claim 4, wherein on condition that the controller has changed the parameter after performing detection with the detector while the during-feeding blowing operation is performed, the controller performs detection with the detector again on the during-feeding blowing operation performed using the parameter previously changed after an elapse of predetermined time, and on condition that a result of the detection fails to satisfy the preset target range, the controller changes the parameter for the medium-feeding operation including at least the during-feeding blowing operation.

6. The medium feeding device according to claim 1, wherein, to perform detection with the detector first during a period when the during-feeding blowing operation is performed, on condition that the controller has changed the parameter after performing detection with the detector while the pre-feeding blowing operation is performed, the controller performs detection with the detector on the during-feeding blowing operation performed using the parameter changed in the pre-feeding blowing operation, and on condition that a result of the detection fails to satisfy the preset target range, the controller changes the parameter for the medium-feeding operation including at least the during-feeding blowing operation, and wherein to perform detection with the detector for second and subsequent times during a period when the during-feeding blowing operation is performed, on condition that the controller has changed the parameter after performing previous detection with the detector while the during-feeding blowing operation is performed, the controller performs detection with the detector again on the during-feeding blowing operation performed using the parameter previously changed after an elapse of predetermined time, and on condition that a result of the detection fails to satisfy the preset target range, the controller changes the parameter for the medium-feeding operation including at least the during-feeding blowing operation.

7. The medium feeding device according to claim 1, wherein the controller performs detection with the detector while the during-feeding blowing operation is performed immediately after the discharging member finishes an operation of transporting one of the media and before the hand-over member sucks a next one of the media.

8. The medium feeding device according to claim 1, wherein the controller determines, as a timing to change the parameter, a timing when intermittent operations performed intermittently during the medium-feeding operation are not performed while the during-feeding blowing operation is performed.

9. The medium feeding device according to claim 8, wherein the controller does not perform next detection with the detector on condition that the parameter determined to be changed based on a result of previous detection from the detector is left unchanged while the during-feeding blowing operation is performed.

10. The medium feeding device according to claim 8, wherein the controller does not perform any of detection with the detector, a change of the parameter, and the detection and the change in a predetermined time period after the change of the parameter while the during-feeding blowing operation is performed.

11. The medium feeding device according to claim 1, wherein after repeating detection with the detector and a change of the parameter the predetermined number of times while the during-feeding blowing operation is performed, the controller performs detection with the detector, and the controller includes a limiter that limits, on condition that a result of the detection fails to satisfy the target range, the medium feeding operation to be performed after the operation of feeding a medium that is being fed is finished.

12. The medium feeding device according to claim 1, wherein after repeating detection with the detector and a change of the parameter the predetermined number of times while the pre-feeding blowing operation is performed, the controller performs detection with the detector, and the controller includes a terminator that terminates, on condition that a result of the detection fails to satisfy the target range, the pre-feeding blowing operation.

13. The medium feeding device according to claim 1, wherein the detector detects an interval between, of all the media floating within a detection area, each pair of media adjacent to each other in a vertical direction as a separation state of the media, and wherein the target range corresponds to no interval smaller than a predetermined range.

14. The medium feeding device according to claim 1, wherein the controller controls, as a control target, an air suction operation performed by the hand-over member in addition to the pre-feeding blowing operation and the during-feeding blowing operation performed by the floating device, and is capable of changing a parameter of the control target.

15. The medium feeding device according to claim 1, comprising:

an air handling member that blows separation air to an upper medium and a medium located below the upper medium, the upper medium being floated by the floating device toward an end of the floated medium in the discharging direction in which the medium is discharged, wherein the controller controls, as a control target, an air blowing operation of the air handling member in addition to the pre-feeding blowing operation and the during-feeding blowing operation performed by the floating device, and is capable of changing a parameter of the control target.

16. The medium feeding device according to claim 1, wherein the parameter for the medium-feeding operation includes at least one of an airflow rate, a direction of air, an area to which air is blown, an air temperature, an air suction rate, an initial uppermost position of the accommodated media, or a separation position of overlapping media.

17. A medium processing device, comprising:

the medium feeding device according to claim 1; and a processing member that performs a predetermined process on the media fed from the medium feeding device.

18. The medium feeding device according to claim 1, wherein the controller changes the operation mode by temporarily stopping the medium-feeding operation.

19. The medium feeding device according to claim 18, wherein, after temporarily stopping the medium-feeding operation, the controller restarts the medium-feeding operation, if the result of the detection is within preset target range, and the controller stops operation of the medium feeding device, if the result of the detection fails to satisfy the preset target range.

20. A medium feeding device, comprising:

a container member that accommodates sheet media;

a discharging member located further than the media accommodated in the container member in a discharging direction in which the media are discharged, to discharge the media one by one;

a hand-over member disposed above the container member to suck the media accommodated in the container member with air and pass the media to the discharging member;

a floating device disposed on a side of the media accommodated in the container member to blow air to an upper area of a side end surface of the media to float the media while an upper portion of the media is separated;

a detector that detects a separation state of the medium floated by the floating device; and a controller that controls a medium-feeding operation including a pre-feeding blowing operation and a during-feeding blowing operation, the pre-feeding blowing operation serving as an air blowing operation performed by the floating device before the medium is fed, and the during-feeding blowing operation serving as an air blowing operation performed by the floating device from a start of feeding the medium to an end of feeding the medium, wherein after the media are feedably accommodated in the container member and while performing the pre-feeding blowing operation and the during-feeding blowing operation, the controller performs detection with the detector, and on condition that a result of the detection fails to satisfy a preset target range, the controller changes a parameter for the medium-feeding operation including at least one of the pre-feeding blowing operation or the during-feeding blowing operation, wherein the detector detects a thickness of each of the media floating within a detection area, wherein the target range corresponds to no medium having a thickness larger than a predetermined range, wherein the target range is set variable with information of a type of the media, wherein the controller counts a number of times the controller changes the parameter, and wherein if the result of the detection fails to satisfy the preset target range and the number of times is less than a predetermined number of times, the controller changes the parameter for the medium-feeding operation including at least the pre-feeding blowing operation or the during-feeding blowing operation, and if the result of the detection fails to satisfy the preset target range and the number of times is equal to or more than the predetermined number of times, the predetermined number of times being more than one, the controller controls the medium feeding device so as to change an operation mode thereof.

* * * * *